US007113712B2

(12) United States Patent
Gomi

(10) Patent No.: US 7,113,712 B2
(45) Date of Patent: Sep. 26, 2006

(54) IMAGE FORMING APPARATUS

(75) Inventor: Fumiteru Gomi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/014,783

(22) Filed: Dec. 20, 2004

(65) Prior Publication Data

US 2005/0175365 A1 Aug. 11, 2005

(30) Foreign Application Priority Data

Dec. 24, 2003 (JP) ..... 2003-428474

(51) Int. Cl.
*G03G 15/00* (2006.01)

(52) U.S. Cl. ..... 399/48; 399/49; 399/51

(58) Field of Classification Search ..... 399/49, 399/48, 51
See application file for complete search history.

(56) References Cited

U.S. PATENT DOCUMENTS 5,694,223 A * 12/1997 Katori et al. ..... 358/300
6,266,495 B1 7/2001 Yuminamochi et al. ..... 399/66
6,529,694 B1 * 3/2003 Fukaya et al. ..... 399/46

FOREIGN PATENT DOCUMENTS

JP 11-258931 9/1999

* cited by examiner

*Primary Examiner*—William J. Royer
(74) *Attorney, Agent, or Firm*—Fitzpatrick, Cella, Harper & Scinto

(57) ABSTRACT

A high-precision image control method that can be conducted frequently without time or labor. When a sheet-passing operation starts, maximum exposure is performed at present settings in a predetermined non-image forming area and potential is detected by a potential sensor. Detected potential is compared with $V_H$ at a first control to judge whether a difference of 10 V or more exists. For a difference of 10 V or more, the signal is made responsive to laser output for achieving $V_H$ set at the first control. When the last image forming for that job is performed, potential returns to the potential set at the first control, and control ends. When the last image forming is completed in a consecutive job during short-term variability of $V_H$, $V_H$ is restored to its original potential before the next job, whereby settings obtained with the first control are restored.

4 Claims, 27 Drawing Sheets

$$\begin{pmatrix} R4 \\ G4 \\ B4 \end{pmatrix} = \begin{pmatrix} a11 & a12 & a13 \\ a21 & a22 & a23 \\ a31 & a32 & a33 \end{pmatrix} \begin{pmatrix} R3 \\ G3 \\ B3 \end{pmatrix} \quad \text{---------(1)}$$

IMAGE FORMING APPARATUS

BACKGROUND OF THE INVENTION

1. Field of the Invention

The present invention relates to an image forming apparatus such as a printer, copier or facsimile machine.

2. Related Background Art

As described in Japanese Patent Application Laid-Open No. H11-258931, the methods described hereunder are conventionally known as methods that adjust image processing characteristics (hereunder, referred to as "image control method") in image forming apparatuses such as printers, copiers and facsimile machines.

According to one method, after an image forming apparatus is turned on and warm-up operations are completed, a specific pattern is formed on an image bearing member such as a photosensitive drum. The density of the formed pattern is then read, and based on the obtained density value, operations of circuits that determine the image forming conditions, such as a γ correction circuit (gamma correction circuit), are changed to stabilize the quality of formed images.

According to another method, when the gradation characteristics of an image forming apparatus have changed due to fluctuations in environmental conditions, the image quality can be stabilized in accordance with the fluctuations in the environmental conditions by forming a specific pattern on an image bearing member once more and reading the density value, and providing feedback again to circuits that determine the image forming conditions such as a γ correction circuit.

Methods are also known which carry out the above-described control for each image forming operation or at the end of each image forming operation to ensure better stabilization.

Further, when an image forming apparatus has been used over a long period, there are cases in which the density that has been read for a pattern on an image bearing member does not match with the density of an image which is actually printed. Therefore, a method is known in which a specific pattern is formed on a recording material and the image forming conditions are then corrected on the basis of the density value thereof.

A method is also known which corrects a gamma look-up table (γLUT) on the basis of density information for one image pattern, creates a γLUT modulation table, and adds correction information that had been lacking in a gamma correction circuit.

Since the control in the afore-mentioned methods involves time and working operations, the image control cannot be carried out frequently. Accordingly, it cannot be said that image quality such as gradation reproduction and the like can be stabilized sufficiently with respect to the imaging characteristics of image forming apparatuses that vary from one minute to the next.

Further, in a method which enables correction of a gamma correction circuit to be conducted comparatively simply by correcting a γLUT based on density information of one image pattern and then adding the correction information to a gamma correction circuit, when the number of additions increases the gradation differences in the γLUT can no longer be disregarded, and thus false contour is generated.

In addition, when increases in potential in an exposure portion vary several dozen volts for several sheets of formed images as a result of accumulation of residual charges on a photosensitive member caused by exposure, even when a method is adopted which detects the densities of patches having a halftone density that are formed in a non-image formation area (non-image forming area) and corrects a γLUT at a high frequency based on the detected values, since it is necessary to set the correction of the γLUT on the premise of a certain degree of stability in the potential, it is not possible to maintain a stable image density and color tint.

SUMMARY OF THE INVENTION

It is an object of this invention to provide an image forming apparatus that can control variations in image density caused by variations in the potential of a photosensitive member.

In one aspect, the present invention provides an image forming apparatus comprising: a photosensitive member; electrostatic image forming means forming an electrostatic image by exposing a surface of the photosensitive member; developing means developing the electrostatic image on the photosensitive member with a toner; potential detecting means detecting a potential of a predetermined electrostatic image that has been formed on the photosensitive member; and correcting means for predicting a surface potential of the photosensitive member on the basis of a detection result previously detected by the potential detecting means and a detection result currently detected during a period in which a plurality of images are formed in succession to correct an exposure output of the electrostatic image forming means in accordance with a predicted surface potential.

In another aspect, the present invention provides an image forming apparatus comprising: a photosensitive member; electrostatic image forming means forming an electrostatic image by exposing a surface of the photosensitive member; developing means developing the electrostatic image on the photosensitive member with a toner; potential detecting means detecting a potential of a predetermined electrostatic image that has been formed on the photosensitive member; storing means storing the potential detected by the potential detecting means; and, correcting means correcting image forming conditions in accordance with a transition in a detected potential stored in the storing means.

Further objects of this invention will be clarified by the detailed description hereunder while referring to the attached drawings.

DESCRIPTION OF THE PREFERRED EMBODIMENTS

Figure 1:
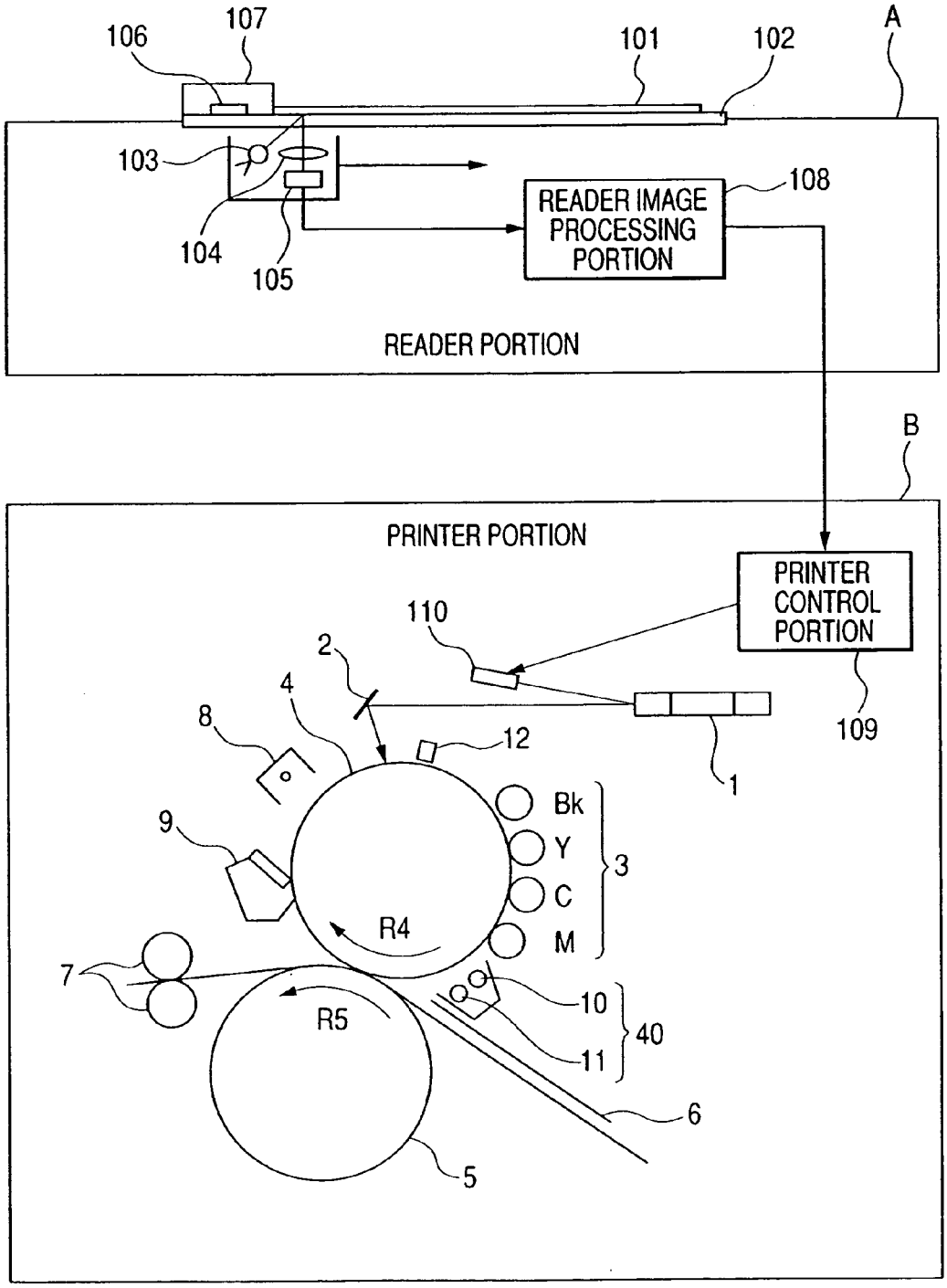
FIG. 1 is a view that schematically shows an outline configuration of the image forming apparatus of Embodiment 1.

Embodiments of this invention are described hereunder referring to the drawings. Items that are denoted by the same symbol in respective drawings are items that have the same configuration or action, and duplicate description for these items has been omitted where appropriate.

First Embodiment (Overall Configuration of Image Forming Apparatus)

FIG. 1 shows an image forming apparatus according to Embodiment 1 as one example of the image forming apparatus of this invention. The image forming apparatus shown in FIG. 1 is an electrophotographic four-color full color copier, and the figure shows a longitudinal section illustrating the outline configuration thereof. The copier (hereunder, referred to as "image forming apparatus") illustrated in the figure comprises a reader portion A for reading an image of an original and a printer portion B that is provided under the reader portion A. Hereunder, the configuration of the reader portion A, printer portion B and image processing portion will be described in order.

<Reader Portion>

As shown in FIG. 1, an original 101 is placed on an original platen glass 102 of the reader portion A in a condition in which the surface of the original is facing downward, and the original 101 is then irradiated by a light source 103. Reflected light from the original 101 forms an image on a CCD sensor 105 via an optical system 104. The CCD sensor 105 is composed of groups of red, green and blue CCD line sensors disposed in 3 rows, and color component signals for red, green and blue are generated for each line sensor. These read optical system units are moved in the direction shown by an arrow in FIG. 1 to convert the image of the original 101 to electrical signals for each line.

On the original platen glass 102 are disposed a positioning member 107 that is contacted against one edge of the original 101 to prevent the original 101 from being disposed in a skewed condition, and a reference white plate 106 for determining the white level of the CCD sensor 105 and conducting shading correction in the thrust direction of the CCD sensor 105.

An image signal obtained by the CCD sensor 105 is subjected to image processing by an image processing portion (reader image processing portion) 108 and sent to the printer portion B, where it is processed by a printer control portion 109 (controlling means and correcting means).

Figures 2A, 2B:
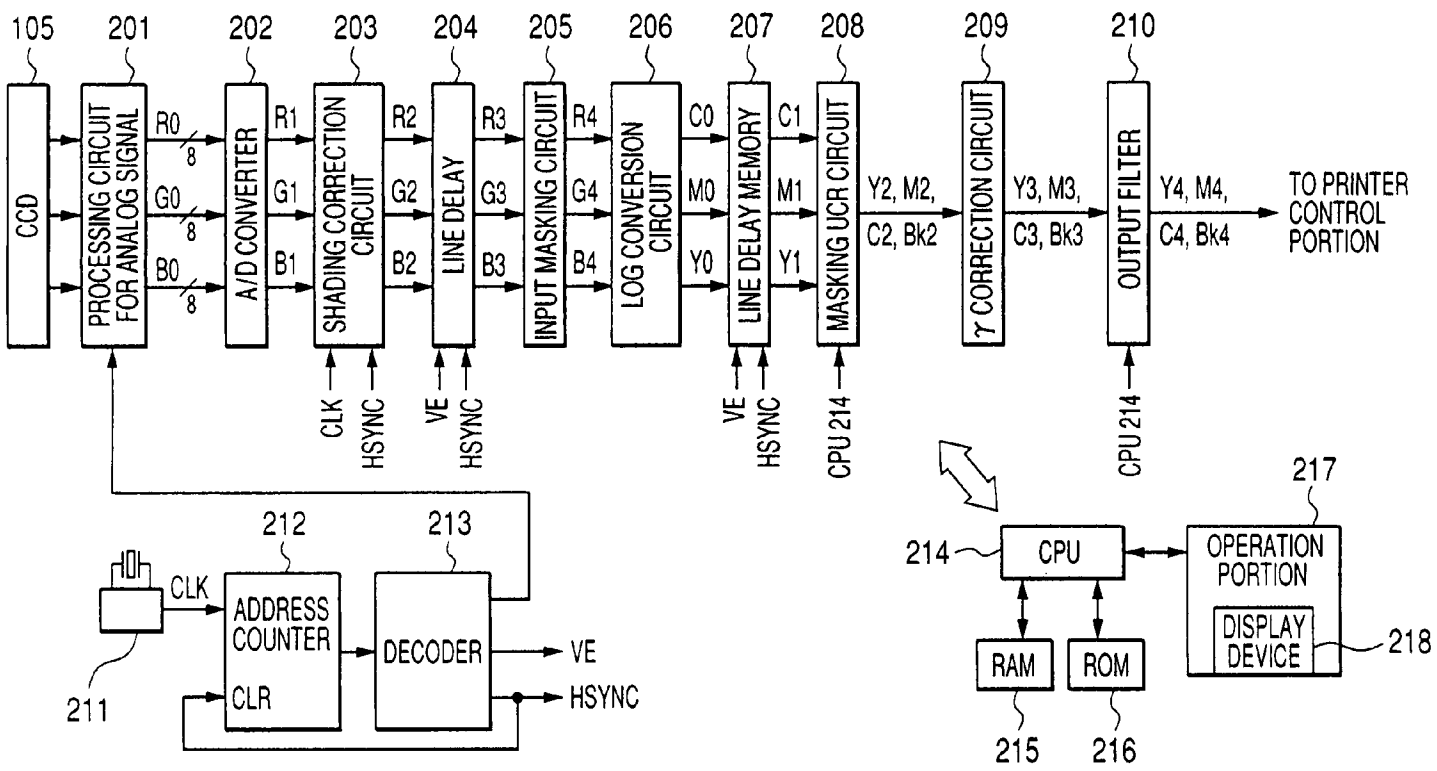
FIGS. 2A and 2B are block diagrams showing the flow of image signals in a reader image processing portion.

FIG. 2A is a block diagram showing the flow of image signals in the image processing portion (controlling means) 108.

As shown in FIG. 2A, image signals that are output from the CCD sensor 105 are input to a processing circuit for analog signals 201, and after adjustment of gain and offset, are converted into 8-bit digital image signals of each color R1, G1 and B1 by an A/D converter 202. The image signals R1, G1 and B1 are input to a shading correction circuit 203 to undergo a known shading correction using read signals of the reference white plate 106 for each color.

A clock generating portion 211 generates a clock CLK of 1 pixel units. An address counter 212 counts the CLK to generate and output a main scanning address signal for each line. A decoder 213 decodes the main scanning address signal and generates a CCD driving signal in line units such as a shift pulse or reset pulse, a signal VE that represents a valid area in a read signal for one line that is output by the CCD 105, and a line synchronization signal HSYNC. The address counter 212 is cleared by the HSYNC and starts counting for the main scanning address of the next line.

The line sensors of the CCD 105 are disposed in a condition in which they are separated from each other by a specified distance in the sub-scanning direction. Therefore, spatial deviations in the sub scanning direction are corrected by a line delay 204. More specifically, by causing an R signal and G signal to undergo a line delay in the sub-scanning direction with respect to a B signal, the spatial positions of the R, G and B signals are aligned.

An input masking circuit 205 converts color spaces (read color spaces) of input image signals decided by spectral characteristics of RGB filters of the CCD 105 into prescribed color spaces (e.g., standard color spaces of sRGB or NTSC) by a matrix calculation shown in formula (1) in FIG. 2B.

A LOG conversion circuit 206 is composed of a look-up table ROM, and converts luminance signals R4, G4 and B4 into density signals C0, M0 and Y0. A line delay memory 207 delays the C0, M0 and Y0 image signals for a line delay amount until judgment signals such as UCR, FILTER and SEN are generated and output from the R4, G4 and B4 image signals by a black character judgment portion (not shown).

A masking UCR circuit 208 extracts a black signal Bk from three primary color signals Y1, M1 and C1 that are input thereto and also performs a computation that corrects color turbidity of a recording colored material of the printer portion B, and outputs Y2, M2, C2 and Bk2 image signals in order with a predetermined bit width (e.g., 8 bits) for each read operation. A γ correction circuit (gamma correction circuit) 209 corrects the image signals to a density that matches the ideal gradation characteristics of the printer portion B. Further, an output filter 210 conducts edge enhancement or smoothing processing for the image signals.

Image signals in a frame sequence of M4, C4, Y4 and Bk4 obtained by the afore-mentioned processing are sent to a printer control portion 109 and converted to pulse signals that were subjected to pulse width modulation, to undergo density recording by the printer portion B.

A CPU 214 carries out control and image processing of the reader portion A in accordance with a program stored in a ROM 216, employing a RAM 215 as a work memory. An operator inputs instructions and processing conditions for the CPU 214 by means of an operation portion 217. A display device 218 displays the operating status of the image forming apparatus or set processing conditions or the like.

Figure 3:
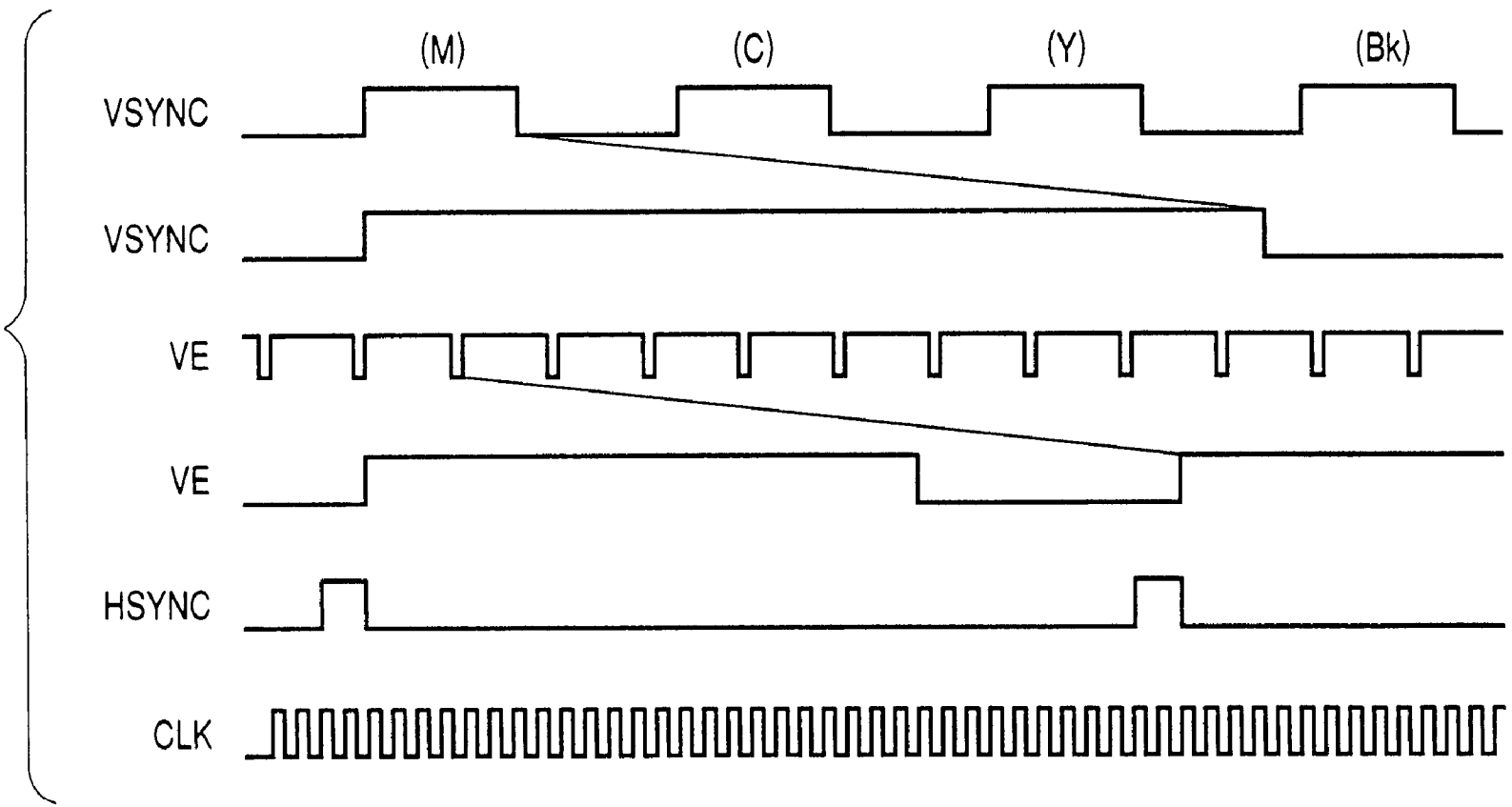
FIG. 3 illustrates a timing chart for each signal in the image processing portion.

FIG. 3 is a timing chart for each signal in the image processing portion 108.

In FIG. 3, VSYNC is an image effective interval signal for the sub-scanning direction which conducts image reading (scanning) in a logical '1' interval to sequentially generate output signals C, M, Y, and Bk. VE is an image effective interval signal for the main scanning direction with which the timing of the main scanning start position in the logical '1' interval is taken, and is principally used for line counting control for line delay. CLK is a pixel synchronizing signal, and image data is transferred at the start-up timing '0'→'1.'

<Printer Portion>

As shown in FIG. 1, the printer portion B comprises as an image bearing member a drum-shaped electrophotographic photosensitive member (hereunder, referred to as "photosensitive drum") 4. The photosensitive drum 4 is driven by driving means (not shown) to rotate at a predetermined process speed (peripheral velocity) in the direction of an arrow R4, and the surface thereof is uniformly charged to a predetermined potential and polarity by a primary charging device 8. The printer control portion 109 outputs a pulse signal in accordance with input image data by means of a laser driver 26 (see FIG. 4). A laser light source (laser sending apparatus) 110 as an exposing apparatus outputs a laser beam in accordance with an input pulse signal. The laser beam is reflected by a polygon mirror 1 and a mirror 2 to scan the surface of the charged photosensitive drum 4. The scanning of the laser beam causes an electrostatic latent image to form on the surface of the photosensitive drum 4.

The electrostatic latent image formed on the surface of the photosensitive drum 4 is developed for each of the colors magenta (M), cyan (C), yellow (Y) and black (Bk) by developing devices 3 with toner of each color. In this embodiment, the developing devices for each color use two-component toner and are disposed around the circumference of the photosensitive drum 4 in the order of black, yellow, cyan and magenta from the upstream side along the direction of rotation of the photosensitive drum 4. Of these developing devices for the four colors, the developing device corresponding to the relevant image formation color approaches the photosensitive drum 4 and attaches toner to the electrostatic latent image to develop it as a toner image (image).

A recording material (recording medium: for example, a sheet of paper or transparent film) 6 is wound around a transferring drum 5 that rotates one time in the direction of an arrow R5 for each color component, so that by rotating a total of four times the toner image of each color is transferred to be superimposed onto the recording material 6. When transfer is completed the recording material 6 separates from the transferring drum 5 to undergo heating and compression by a pair of fixing rollers 7 to fix the toner images to the surface thereof. Thus, printing of a four color full color image is completed.

On the periphery of the photosensitive drum 4, a surface potential sensor (potential detecting means) 12 that measures the surface potential of the photosensitive drum 4 is disposed on the upstream side of the developing devices 3, a cleaner 9 for cleaning residual toner on the photosensitive drum 4 that has been not transferred is disposed on the upstream side of the primary charging device 8, and a photodiode 11 and an LED light source 10 for detecting the amount of reflected light of a patch (a toner image for density detection) formed on the photosensitive drum 4 are disposed on the downstream side of the developing devices 3.

Figure 4:
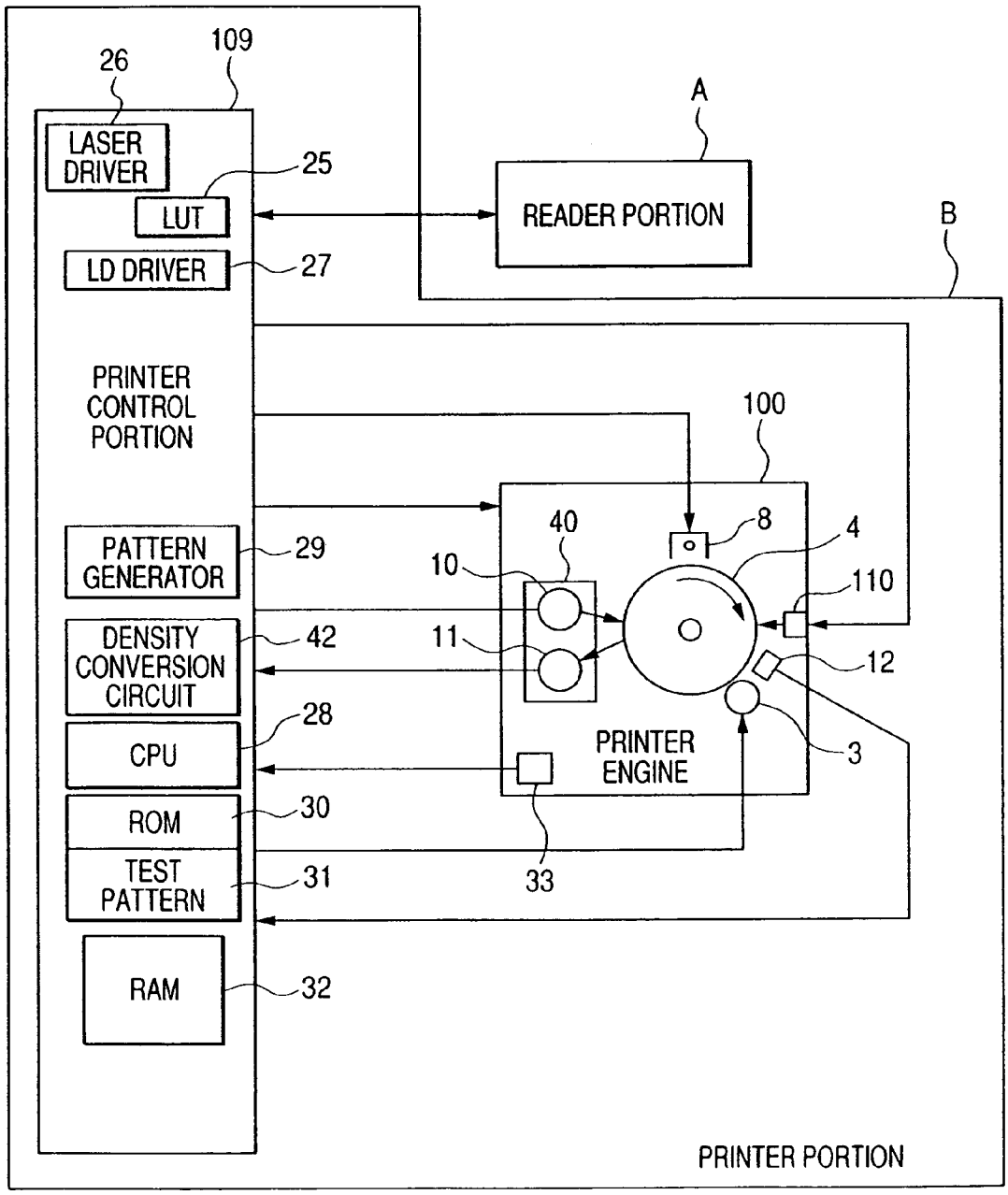
FIG. 4 is a block diagram showing a configuration example of a printer portion.

FIG. 4 is a block diagram showing a configuration example of the printer portion B.

The printer control portion 109 is composed of a CPU 28, a ROM 30, a RAM 32, a test pattern memory portion 31, a density conversion circuit 42, an LUT (γLUT) 25, a laser driver 26 and the like, and is capable of communicating with the reader portion A and a printer engine 100. The CPU 28 controls the operation of the printer portion B and also controls the grid potential of the primary charging device 8 and the developing bias of the developing devices 3.

In addition to the photosensitive drum 4, the printer engine 100 is composed of a photosensor (second detecting means: optical sensor) 40 as an image characteristics detecting means comprising the LED 10 and the photodiode 11; the primary charging device 8; the laser light source 110; the surface potential sensor 12; the developing devices 3; and the like that are disposed around the periphery of the photosensitive drum 4. The printer engine 100 also comprises an environment sensor 33 that determines the moisture amount (or temperature and relative humidity) in the air within the image forming apparatus. In this embodiment, a specular reflection device is used for the optical sensor 40.

<Configuration of Image Processing Portion>

Figure 5:
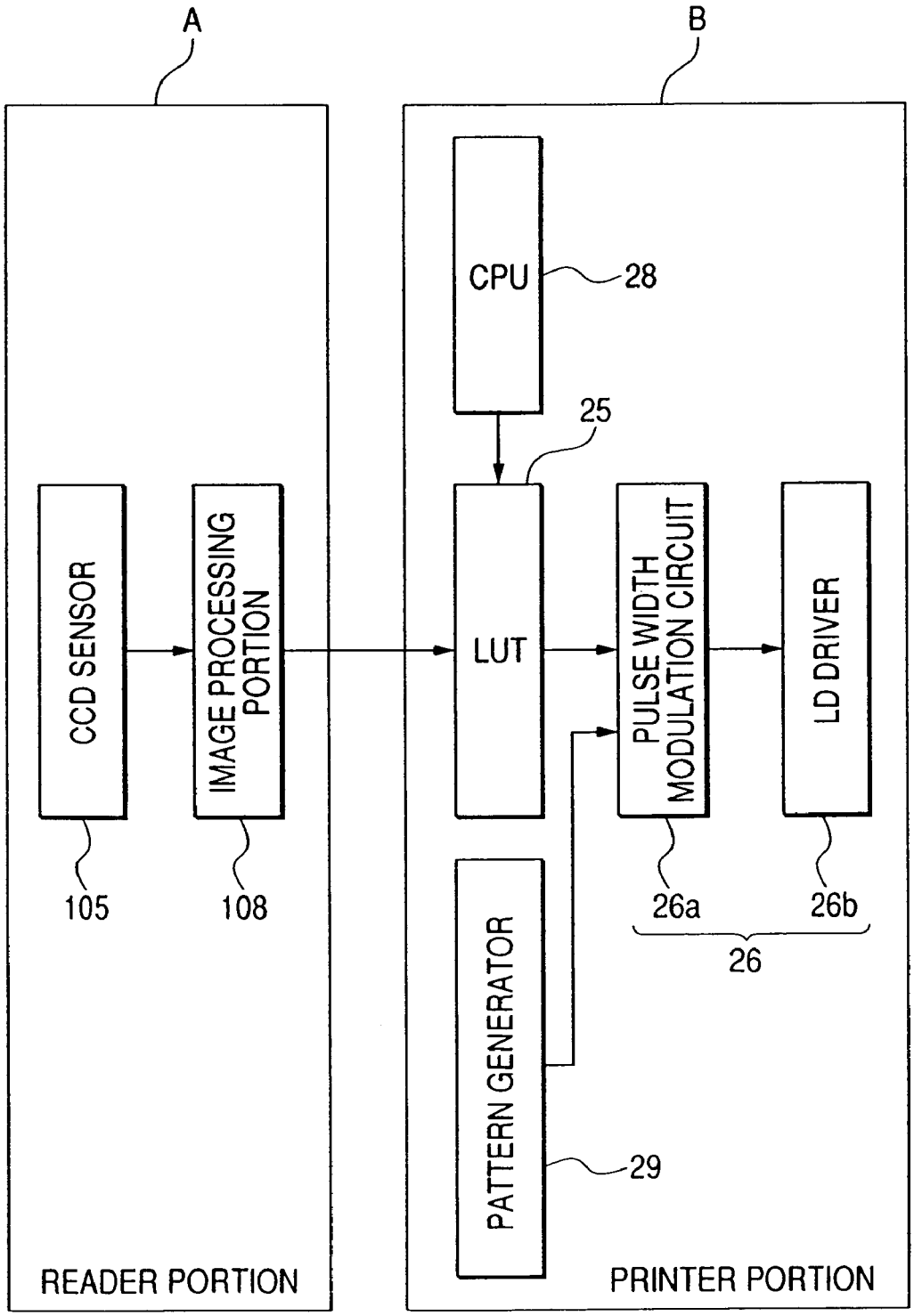
FIG. 5 is a block diagram showing a configuration example of an image processing portion for obtaining a gradation image.

FIG. 5 is a block diagram showing a configuration example of the image processing portion 108 for obtaining a gradation image.

Luminance signals of an image obtained by the CCD 105 are converted into density signals in frame sequence in the image processing portion 108. The characteristics of the density signals after conversion are corrected by the LUT (γLUT) 25 so that the signals correspond to the γ characteristics (gamma characteristics) of the printer at the time of initial settings, that is, so that the density of the original image and the density of the output image match.

Figure 6:
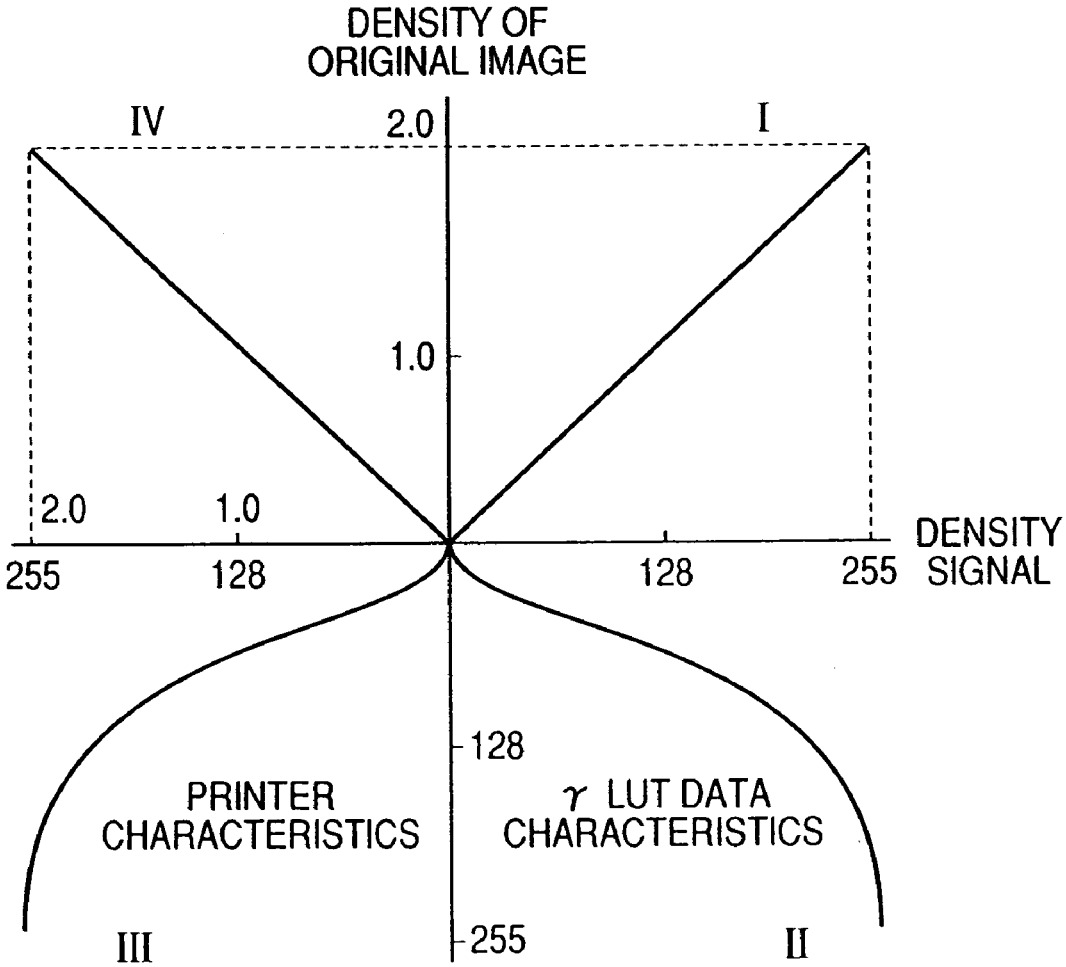
FIG. 6 is a four-quadrant chart showing the manner in which a gradation is reproduced.

FIG. 6 is a four-quadrant chart showing the manner in which a gradation is reproduced. A quadrant I shows the read characteristics of the reader portion A that converts the density of the original image into a density signal, a quadrant II shows the conversion characteristics of the LUT 25 for converting the density signal into a laser output signal, a quadrant III shows the recording characteristics of the printer portion B that converts the laser output signal into density of the output image, and a quadrant IV shows the relation between the original image and the density of the output image. The entire four-quadrant chart shows the total gradation reproduction characteristics of the image forming apparatus shown in FIG. 1. The chart illustrates a case where the number of gradation levels is 256 and processing is conducted with 8-bit digital signals.

In order to make the total gradation characteristics of the image forming apparatus, i.e., the gradation characteristics of quadrant IV, linear, a nonlinear part of the printer characteristics of quadrant III is corrected by the LUT 25 of quadrant II. An image signal for which the gradation characteristics were converted by the LUT 25 is converted into a pulse signal corresponding to a dot width by a pulse width modulation (PWM) circuit 26*a* of the laser driver 26 (see FIG. 5), and sent to an LD driver 26*b* that controls an ON/OFF operation of the laser light source 110. In this embodiment, a gradation reproduction method employing pulse width modulation is used for all of the colors Y, M, C and Bk.

An electrostatic latent image having predetermined gradation characteristics for which gradation has been controlled by changes in the dot area is then formed on the photosensitive drum 4 by scanning of a laser beam output from the laser light source 110, after which a gradation image is reproduced through the afore-mentioned process of development, transfer and fixing.

[First Control System]

Next, a first control system that relates to stabilization of image reproduction characteristics of a system including both the reader portion A and the printer portion B is described as an image control that forms an image on the recording material 6.

First, a control system that calibrates the printer portion B using the reader portion A will be described.

Figure 7:
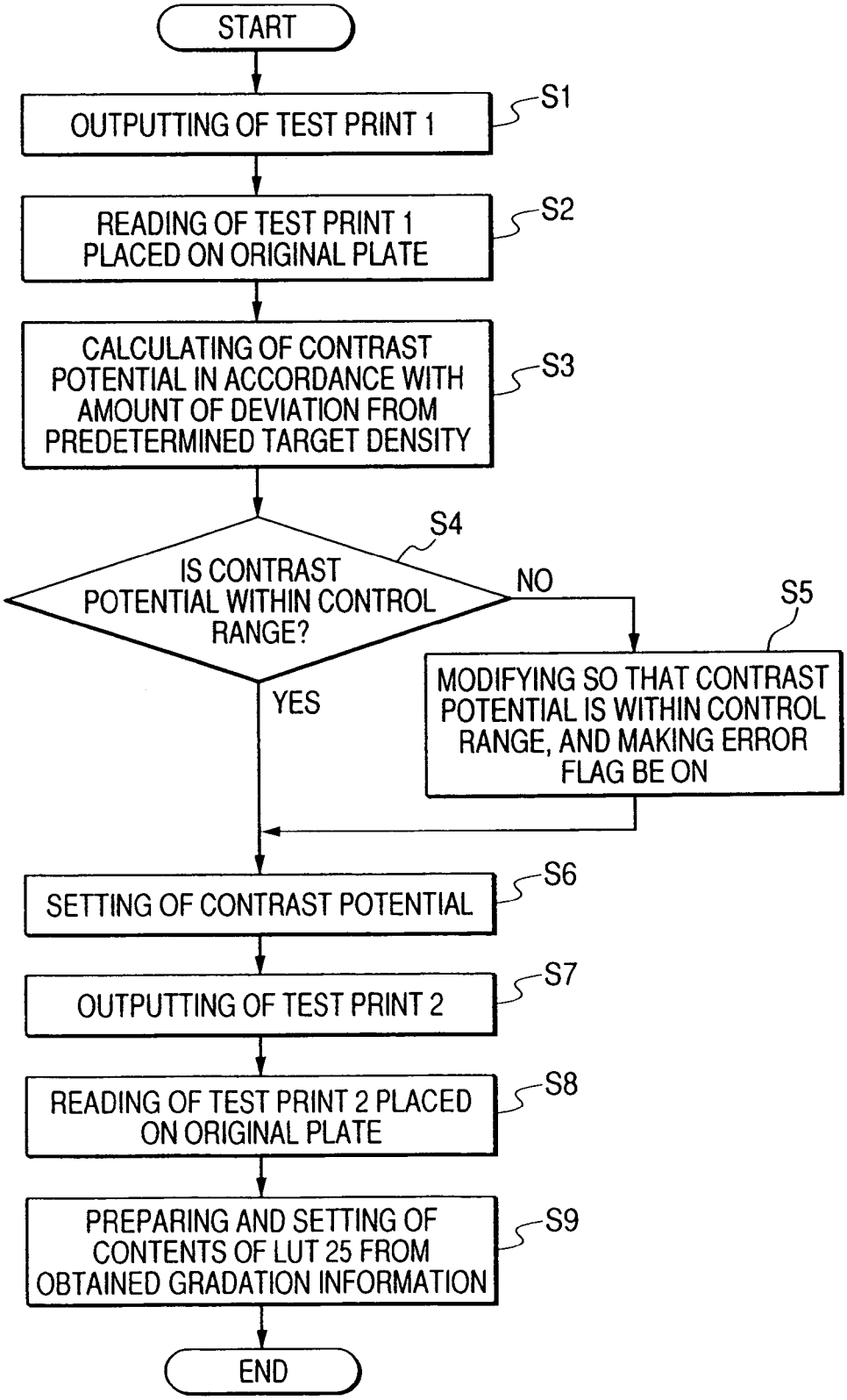
FIG. 7 is a flowchart illustrating one example of calibration.

FIG. 7 is a flowchart showing one example of calibration. Calibration is carried out by joint operations of the CPU 214 that controls the reader portion A and the CPU 28 that controls the printer portion B.

When an operator presses, for example, a mode setting button "automatic gradation correction" provided on the operation portion 217 (see FIG. 2A), the calibration illustrated in FIG. 7 starts. In this connection, as shown in FIGS. 8A to 8C, 9A to 9C, and 10A to 10E, the display device 218 is composed of a liquid crystal operation panel with a touch sensor (touch panel display).

Figure 8A:
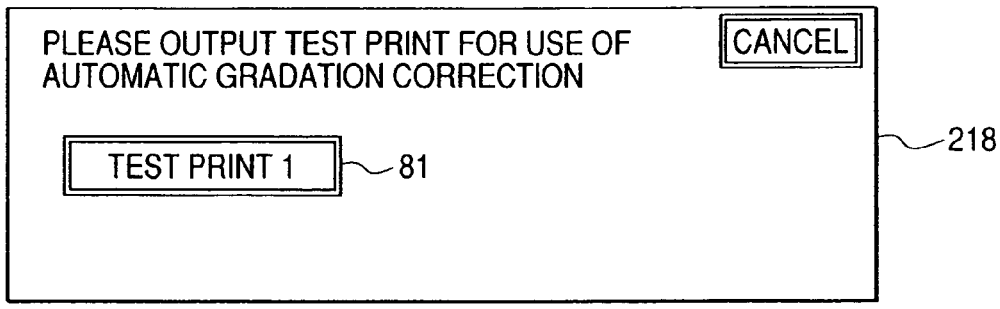
FIGS. 8A, 8B and 8C are views showing examples of the display on a display device with respect to a test print 1.
Figure 8B:
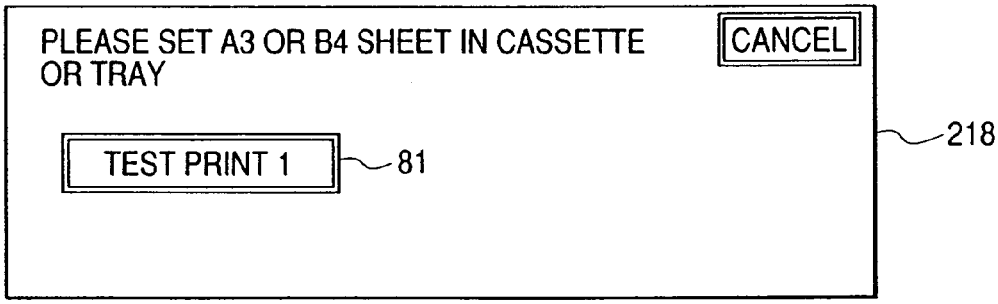
Figure 8C:
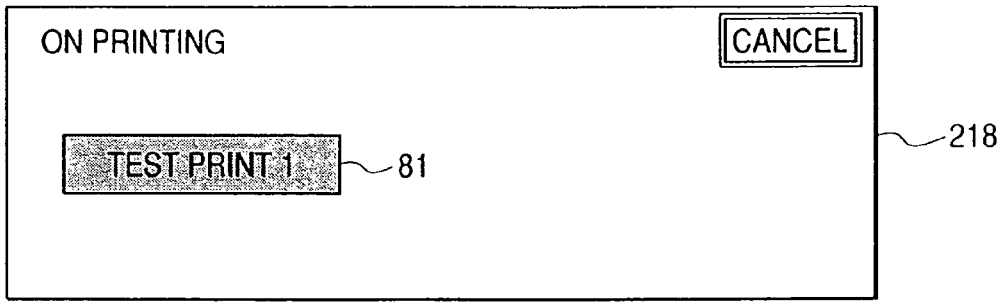
Figure 11:
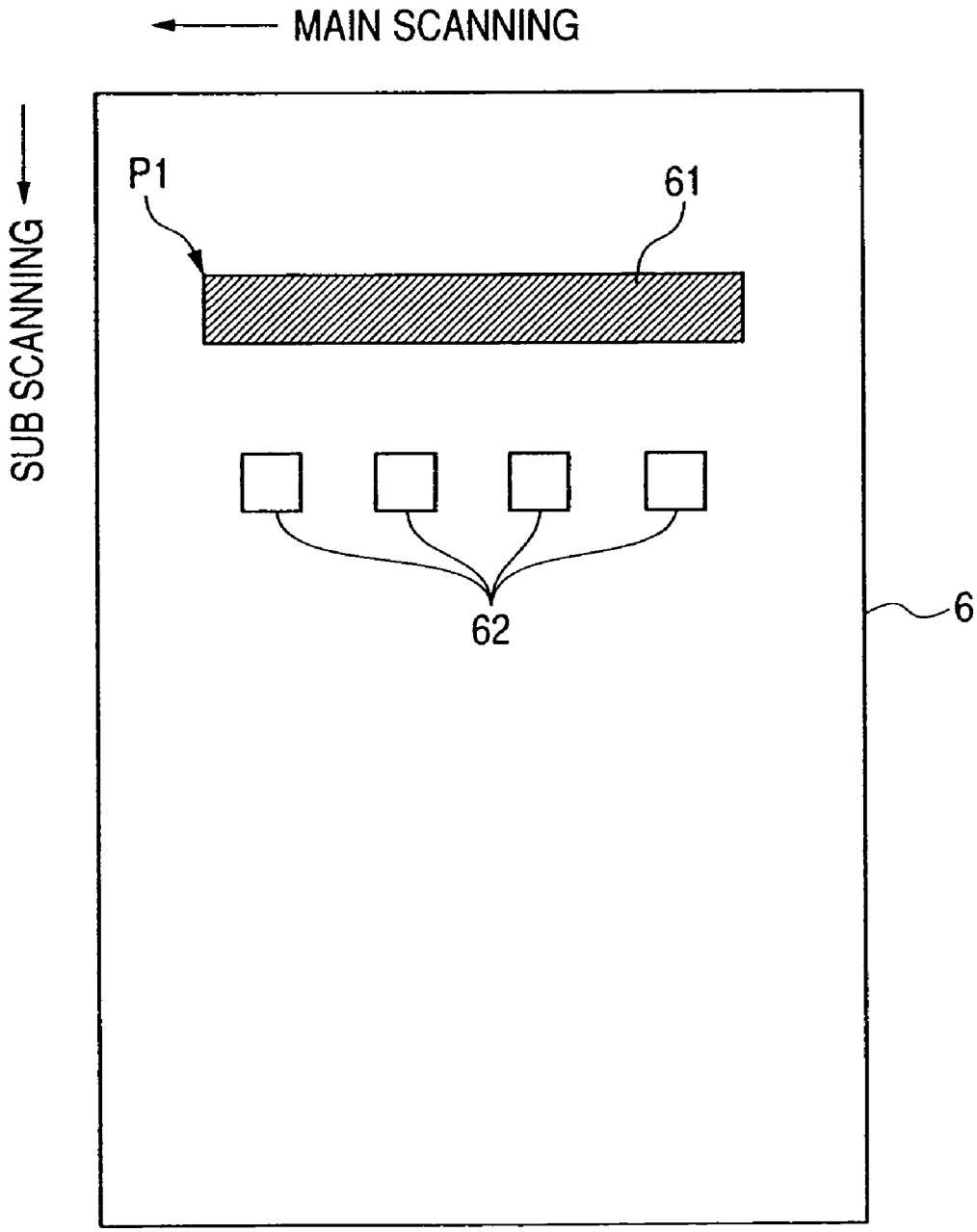
FIG. 11 is a view showing an example of the test print 1.

First, a "test print 1" button 81 that is a start button for a test print 1 appears on the display device 218, as shown in FIG. 8A. When the operator presses the "test print 1" button 81, the test print 1 as shown in FIG. 11 is printed out by the printer portion B (S1 in FIG. 7). The display during printing is as shown in FIG. 8C. At this time, the CPU 214 determines the presence or absence of the recording material 6 for forming the test print 1, and if the recording material 6 does not exist the CPU 214 displays a warning message as shown in FIG. 8B on the display device 218.

The contrast potential used when forming the test print 1 is the contrast potential of a standard state that corresponds to the environment that is registered as an initial value. Further, the image forming apparatus comprises a plurality of recording material cassettes, for example, recording material cassettes that individually store recording materials 6 of sizes such as B4, A3, A4 and B5, respectively, and the recording material 6 of a desired size can be selected from these. However, in this embodiment, in order to prevent an error in which a mistake is made with respect to vertical placement and horizontal placement in a subsequent reading operation, the recording material 6 to be used for this control is set so that a so-called large size paper, that is, a size such as B4, A3, 11×17 or LGR, is used.

Figure 12:
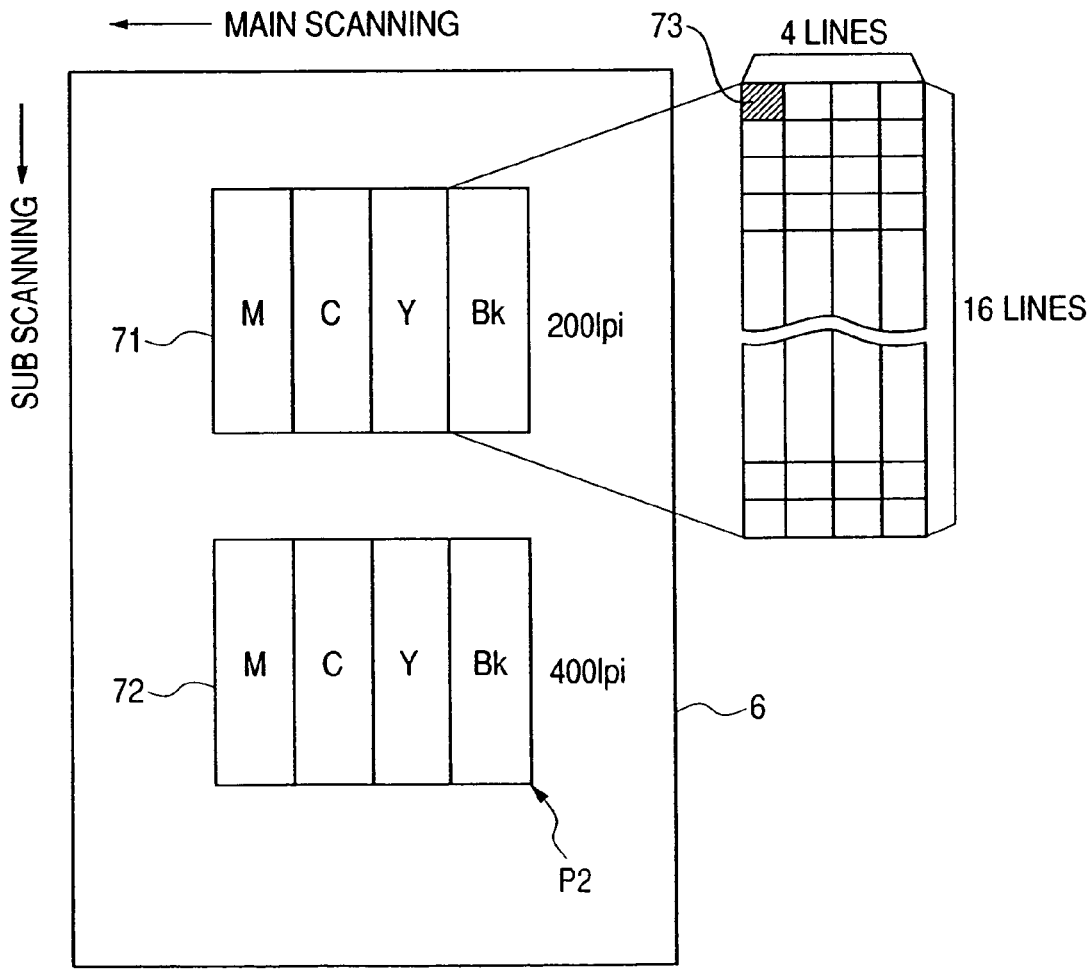
FIG. 12 is a view showing an example of the test print 2.

The test pattern 1 shown in FIG. 11 includes a belt-shaped pattern 61 formed by the halftone densities of the four colors Y, M, C and Bk. By visually inspecting this pattern 61, the operator can confirm that there are no abnormal image streaks, density inconsistencies or color inconsistencies. The sizes of patch patterns 62 as well as gradation patterns 71 and 72 shown in FIG. 12 are set so that they enter the reading range in the thrust direction of the CCD sensor 105.

In a case where an abnormality is found by the visual inspection, the test print 1 is printed again, and if an abnormality is again found it is necessary to call a serviceman to carry out maintenance. In this connection, based on density information in the thrust direction obtained by reading the belt pattern 61 with the reader portion A, judgment may also be rendered automatically regarding whether or not to carry out subsequent control operations.

The patch patterns 62 are maximum density patches of each of the colors Y, M, C and Bk, that is, patch patterns corresponding to a density signal value 255.

Figure 9A:
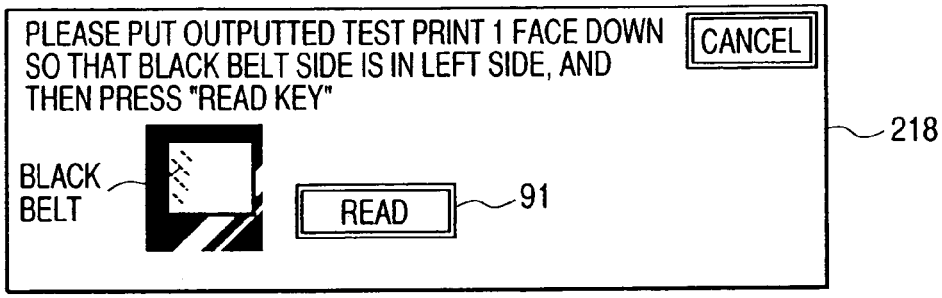
FIGS. 9A, 9B and 9C are views showing examples of the display on a display device with respect to a read operation.
Figure 13:
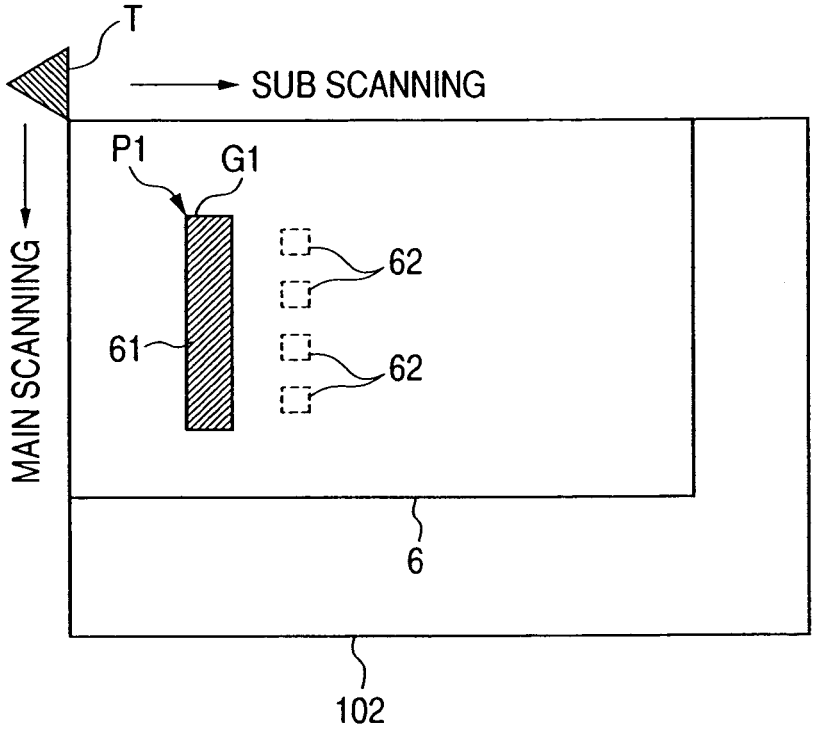
FIG. 13 is a view showing a state in which the test print 1 is placed on the original platen glass.

Next, the operator places the test print 1 on the original platen glass 102 in the manner shown in FIG. 13 and presses a "read" button 91 shown in FIG. 9A. At this time, as shown in FIG. 9A, operation guidance for the operator is displayed on the display device 218.

FIG. 13 is a view of the original plate 102 when viewed from above. A wedge-shaped mark T on the upper left side of the figure is a mark for contacting with an original. An operation guidance message is displayed on the display device 218 to guide the operator so that a corner P1 of the belt pattern 61 is disposed on the side of the contact mark T and a mistake is not made regarding the front and back sides of the print. That is, the object of the operation guidance is to prevent erroneous control due to an error when disposing the test print 1.

Figure 9B:
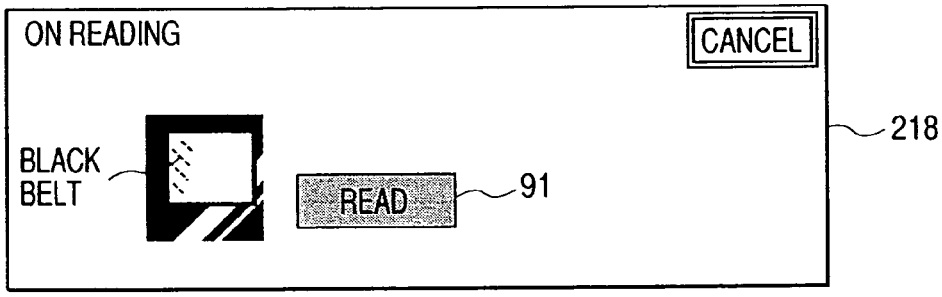
Figure 9C:
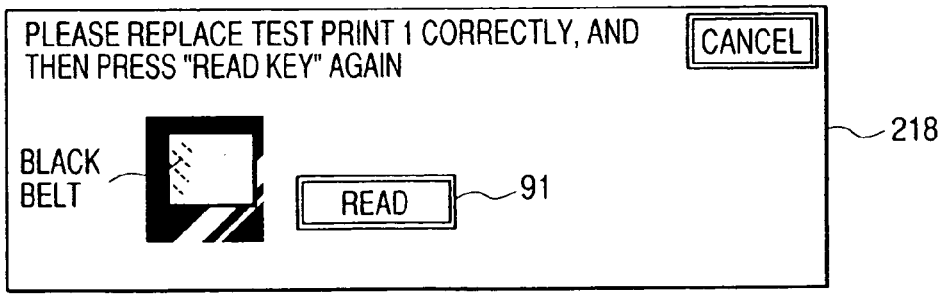

When scanning is gradually conducted from the contact mark T at the time of reading the patch patterns 62, a first density gap point G1 is obtained at the corner P1 of the belt pattern 61. The relative position of each patch of the patch patterns 62 is determined from the coordinates of the density gap point G1, and the densities of the patch patterns 62 are read (S2 in FIG. 7). During reading of the test print 1, a display such as that shown in FIG. 9B is displayed, and when the orientation or position of the test print 1 is incorrect and reading is not possible, a message such as that shown in FIG. 9C is displayed to instruct the operator to correctly replace the test print 1 and press the "read" button 91 to read the test print 1 again.

The following formula (2) is used to convert RGB values obtained from the patch patterns 62 into optical densities. In order to make these values the same as those of a commercially available densitometer they are adjusted with a correction coefficient k. Further, an LUT may be separately prepared to convert brightness information of RGB into density information of MCYBk.

$$M=-km\times\log_{10}(G/255)$$

$$C=-kc\times\log_{10}(R/255)$$

$$Y=-ky\times\log_{10}(B/255)$$

$$Bk=-kk\times\log_{10}(G/255) \quad (2)$$

Figure 15:
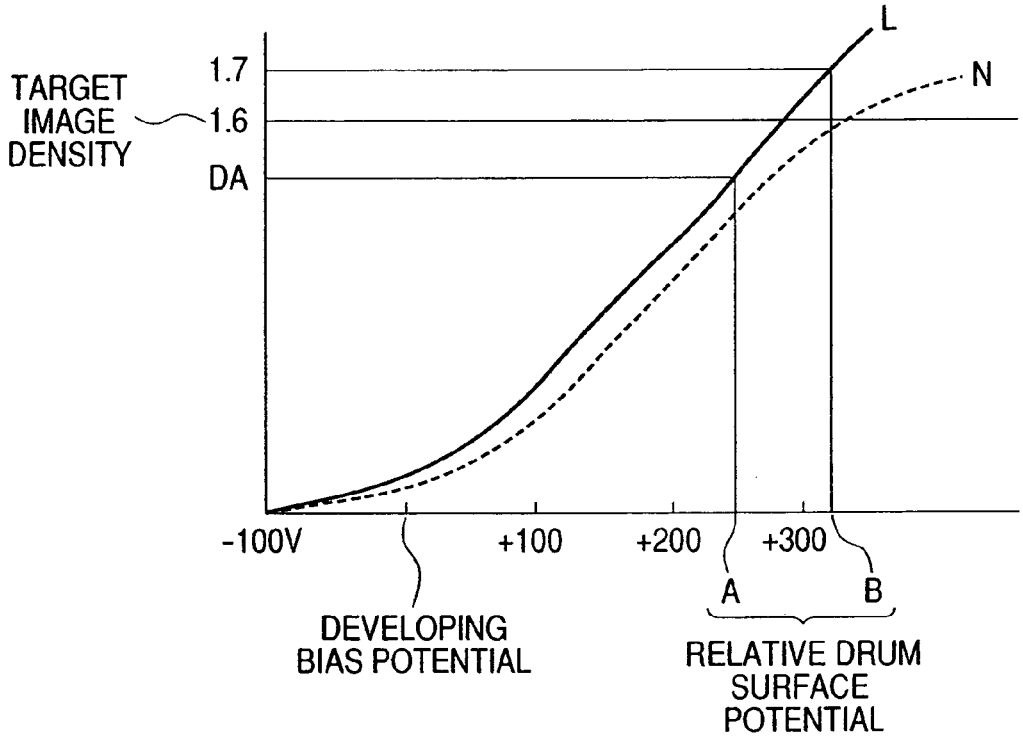
FIG. 15 is a view illustrating the relation between image density and relative drum surface potential of a photosensitive drum.

Next, a method that corrects a maximum density from obtained density information is described. FIG. 15 is a view showing the relation between relative drum surface potential of the photosensitive drum 4 and image density obtained by the afore-mentioned computation.

The contrast potential (difference between developing bias potential and surface potential of the photosensitive drum 4 that has been photosensitized by a laser beam modulated with the maximum signal value (255 in the case of 8 bits) after the photosensitive drum 4 has been subjected to a primary charge) when the test print 1 has been printed is denoted by the reference character A in FIG. 15, and the density obtained from the patch patterns 62 is denoted by the reference character $D_A$.

In a maximum density region, the image density is mainly in a linear correspondence with respect to relative drum surface potential, as shown by a continuous line L in FIG. 15. However, in a two-component developing system, when toner density within the developing devices 3 fluctuates and drops, the image density may become nonlinear in the maximum density region with respect to relative drum surface potential, as shown by a broken line N in FIG. 15. Accordingly, in the example shown in FIG. 15, while the target value for ultimate maximum density is 1.6, the control target value for maximum density is set to 1.7 to allow for a margin of 0.1, to determine the controlled variable. A contrast potential B in this case is determined by the following formula.

$$B=(A+Ka)\times 1.7/DA \quad (3)$$

In formula (3), Ka is a correction coefficient, and depending on the type of development method, that value is preferably optimized.

Figure 16:
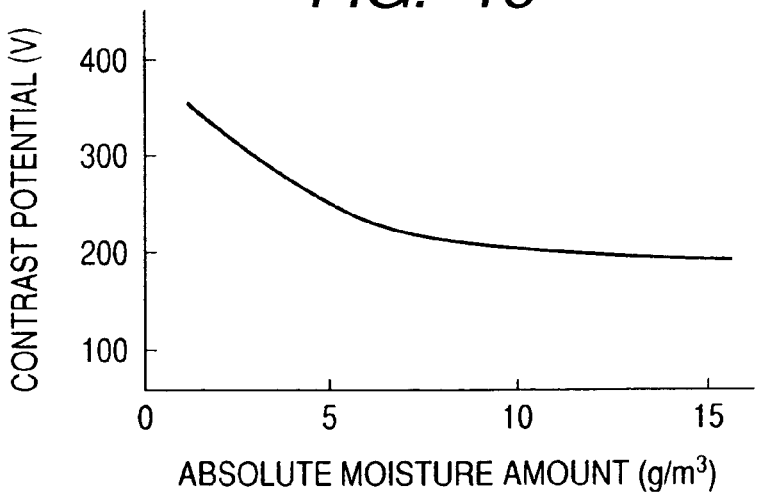
FIG. 16 is a view illustrating the relation between absolute moisture amount and contrast potential.

When the contrast potential of an electrophotographic method is not set in accordance with the environment, the density of the original image and output image will not match, and thus, as shown in FIG. 16, contrast potential corresponding to maximum density is set based on the output of the environment sensor 33 monitoring the moisture amount within the image forming apparatus (i.e., the absolute moisture amount) as described in the foregoing.

Therefore, in order to correct the contrast potential, a correction coefficient Vcont. rate1 shown by the following formula (4) is stored in a backed-up RAM or the like.

$$Vcont.\text{rate}1=B/A \quad (4)$$

The image forming apparatus monitors the moisture amount in the environment by means of the environment sensor 33, for example, every 30 minutes. Then, each time the value for A is determined based on the moisture amount detection result, A×Vcont. rate1 is calculated to obtain the contrast potential.

Figure 17:
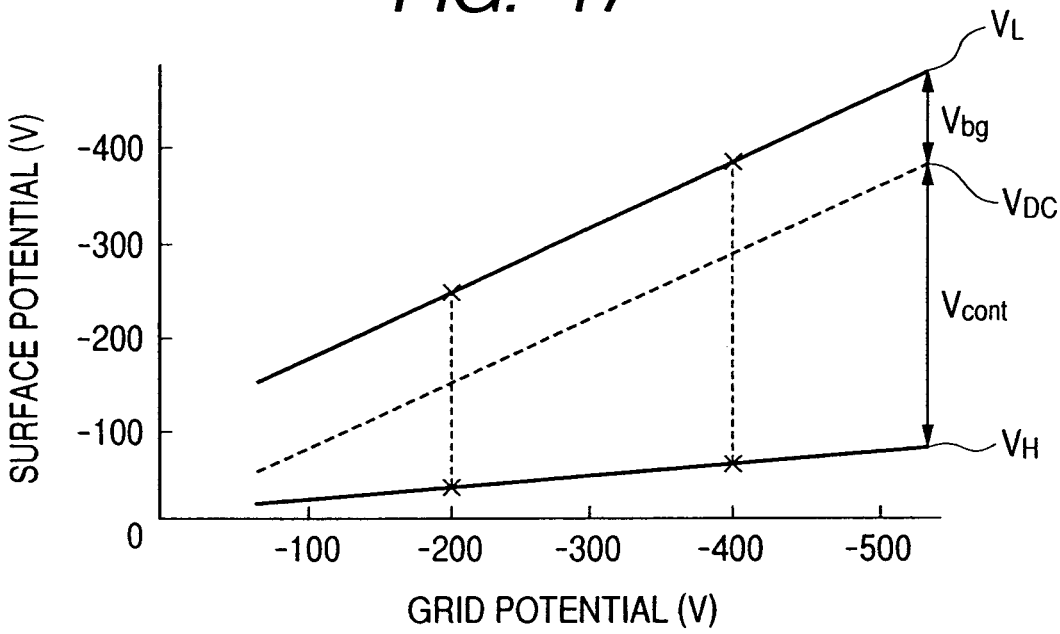
FIG. 17 is a view illustrating the relation between grid potential and surface potential.

Next, a method for determining grid potential and developing bias potential from the contrast potential will be briefly described. FIG. 17 is a view showing the relation between grid potential and surface potential of the photosensitive drum 4.

The grid potential is set at −200 V, and a surface potential $V_L$ of the photosensitive drum 4 that has been photosensitized by a laser beam modulated with the minimum signal value, and a surface potential $V_H$ of the photosensitive drum 4 that has been photosensitized by a laser beam modulated with the maximum signal value are then determined by the surface potential sensor 12. Similarly, $V_L$ and $V_H$ are determined when the grid potential is set at −400 V. The relation between grid potential and surface potential is then determined by interpolating and extrapolating the data acquired at −200 V and the data acquired at −400 V. The control for determining this potential data is referred to as "potential measurement control".

Next, a developing bias $V_{DC}$ is set at a difference from $V_L$ of Vbg (e.g., 100 V) that is set so that toner fogging does not occur in an image. A contrast potential Vcont is the differential voltage between the developing bias $V_{DC}$ and $V_H$, and, for the reasons described in the foregoing, as Vcont increases the maximum density becomes larger.

The grid potential and developing bias for obtaining the contrast potential B that is determined by calculation can be obtained from the relation shown in FIG. 17. Accordingly, the CPU 28 determines a contrast potential whereby the maximum density is 0.1 higher than the ultimate target value, and determines the grid potential and developing bias potential such that the contrast potential in question can be obtained (S3 in FIG. 7).

Next, the CPU 28 determines whether or not the calculated contrast potential is within the control range (S4), and when the contrast potential is outside the control range the CPU 28 determines that an error exists in the developing devices 3 or the like and sets an error flag to ON so that the developing device 3 of the corresponding color is checked. The status of this error flag can be viewed by a serviceman in a predetermined service mode. Further, when an error exists, the contrast potential is modified so that it is just barely within the control range, and control is continued (S5).

The CPU 28 controls the grid potential and developing bias (S6) so that the contrast potential that has been set in the above-described manner can be obtained.

Figure 28:
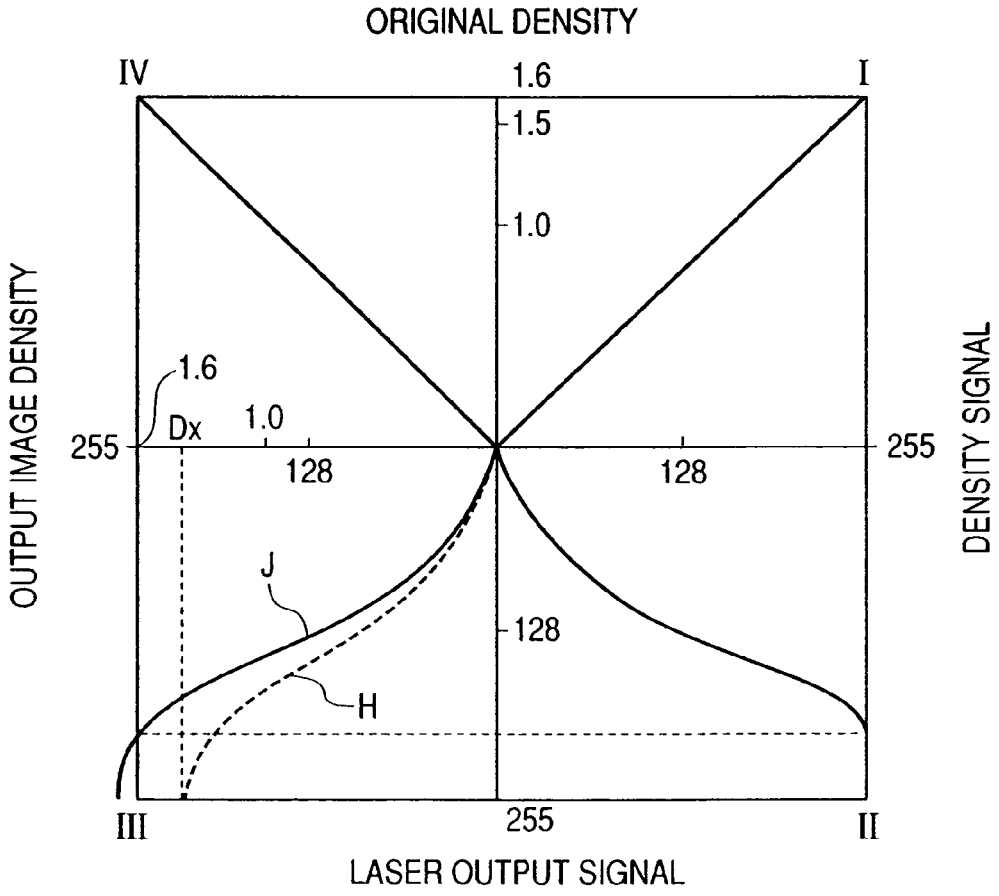
FIG. 28 is a view showing post-control density conversion characteristics.

FIG. 28 is a view showing post-control density conversion characteristics. In this embodiment, the control that sets maximum density to a higher value than the ultimate target value results in printer characteristics for quadrant III that are illustrated by a continuous line J. If, for instance, this type of control has been not performed, there is a possibility that printer characteristics would be obtained for which a maximum density does not reach 1.6, as shown by a broken line H. When the printer characteristics are those shown by the broken line H, the maximum density cannot be raised by the LUT 25 and therefore, no matter how the LUT 25 is set, it is not possible to reproduce the density region between the density $D_H$ and 1.6. For printer characteristics which exceed the maximum density by a small amount, as shown by the continuous line J, the density reproduction area can be ensured by correction by the LUT 25, as shown by the total gradation characteristics of quadrant IV.

Figure 10A:
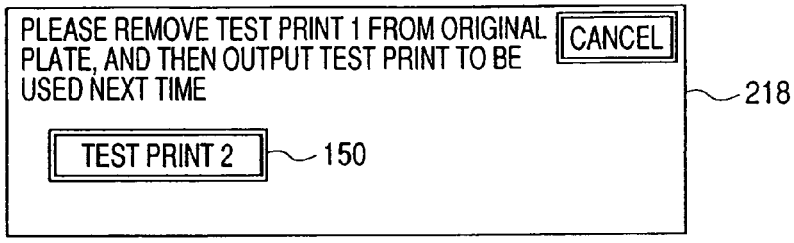
FIGS. 10A, 10B, 10C, 10D, and 10E are views showing examples of the display on a display device with respect to a test print 2.
Figure 10B:
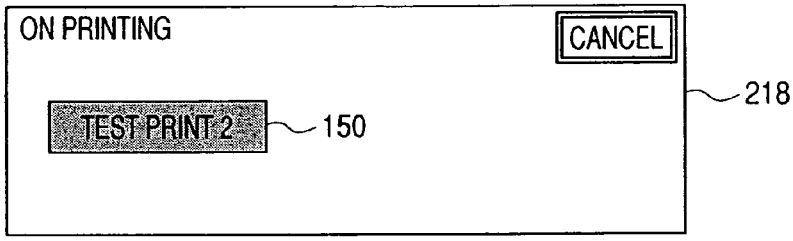
Figure 10C:
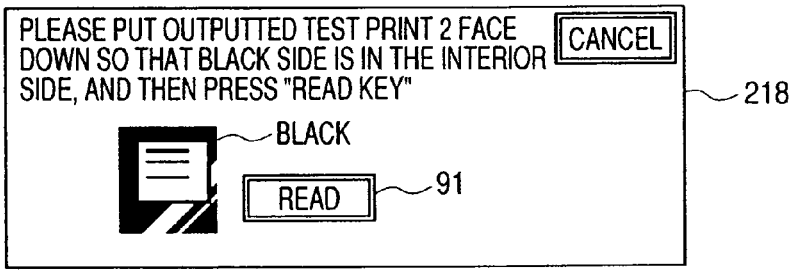

Next, as shown in FIG. 10A, a "test print 2" button 150 appears on the display device 218 as a button to start printing of a test print 2. When the operator presses the "test print 2" button 150, the test print 2 shown in FIG. 12 is printed out (S7). The display during printing is as shown in FIG. 10B.

As shown in FIG. 12, the test print 2 comprises gradation patch groups of 4×16 (number for 64 levels of gradation) patches for each of the colors Y, M, C and Bk. The 64 levels of gradation are mainly allocated to low-density areas among the total 256 levels of gradation and are thinned out for high-density areas. This is done in order to favorably adjust gradation characteristics in highlight portions in particular.

In FIG. 12, patch patterns 71 are groups of patches of a resolution of 200 lpi (line/inch), and patch patterns 72 are groups of patches of a resolution of 400 lpi. The formation of images of each resolution is carried out by preparing a plurality of cycles of signals such as triangular waves for use in comparison with image signals of the processing target in a pulse width modulation circuit 26*a* (see FIG. 5).

Based on an output signal from the afore-mentioned black character judgment portion, the image forming apparatus of this embodiment forms a gradation image such as a photographic image at 200 lpi, and a text or line drawing image or the like at 400 lpi. Although patterns of the same gradation level may be output at these two resolutions, in a case where a difference in resolution significantly affects the gradation characteristics, preferably a pattern of the gradation level that corresponds to the resolution in question is output.

The test print 2 is printed based on image signals generated from a pattern generator 29 without applying the LUT 25.

Figure 14:
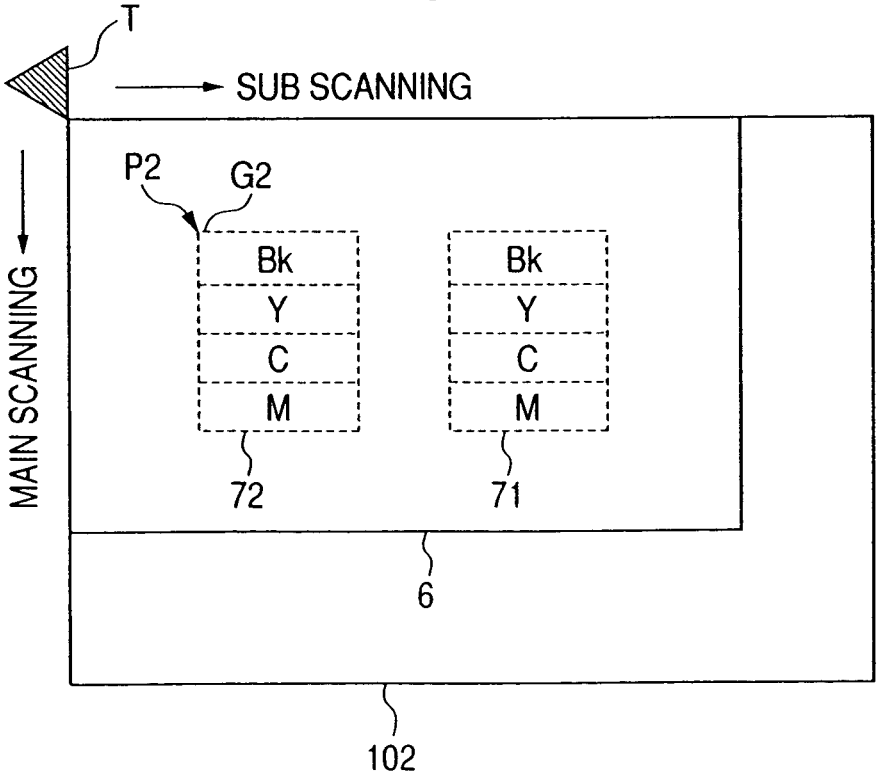
FIG. 14 is a view showing a state in which the test print 2 is placed on the original platen glass.

FIG. 14 is an overhead view of the original platen glass 102 on which the test print 2 has been placed. A message is displayed (see FIG. 10C) on the display device 218 to guide the operator so that the Bk patch patterns are placed on the side of the contact mark T and a mistake is not made regarding the front and back sides of the print, to prevent a control error due to an error when placing the test print 2.

Figure 10D:
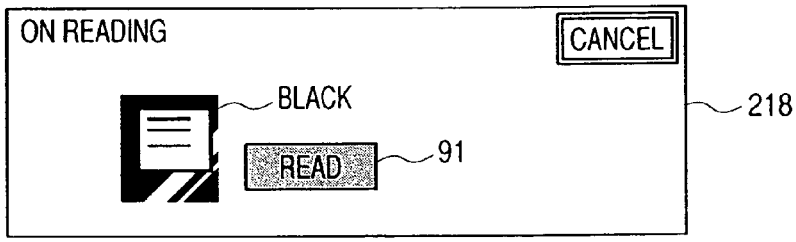

When scanning is gradually conducted from the contact mark T upon reading the patch patterns 71 and 72, an initial density gap point G2 is obtained at a corner P2 of the patch patterns 72 (see FIG. 12 and FIG. 14). The relative position of each patch of the patch patterns 71 and 72 is determined from the coordinates of the density gap point G2, and the densities of the patch patterns 71 and 72 are read (S8 in FIG. 7). During reading of the test print 2, a display such as that shown in FIG. 10D is displayed.

Figure 18:
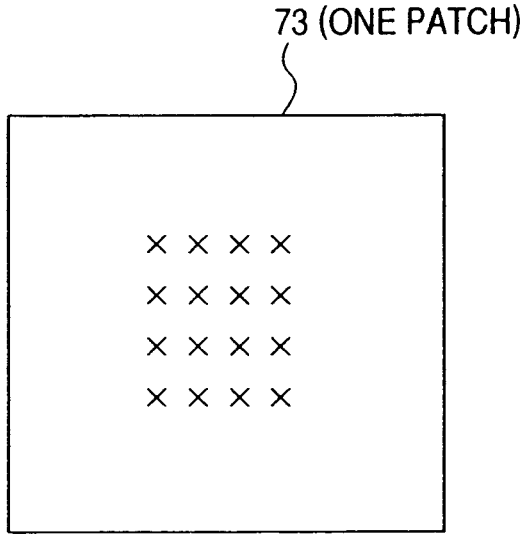
FIG. 18 is a view illustrating the density reading points of a patch.

As shown in FIG. 18, a read value for one patch, for example, a patch 73 shown in FIG. 12, is determined by taking 16 points within the patch 73, and averaging the values obtained by reading the 16 points. In this connection, the number of reading points is preferably optimized according to the reading apparatus and image forming apparatus.

Figure 19:
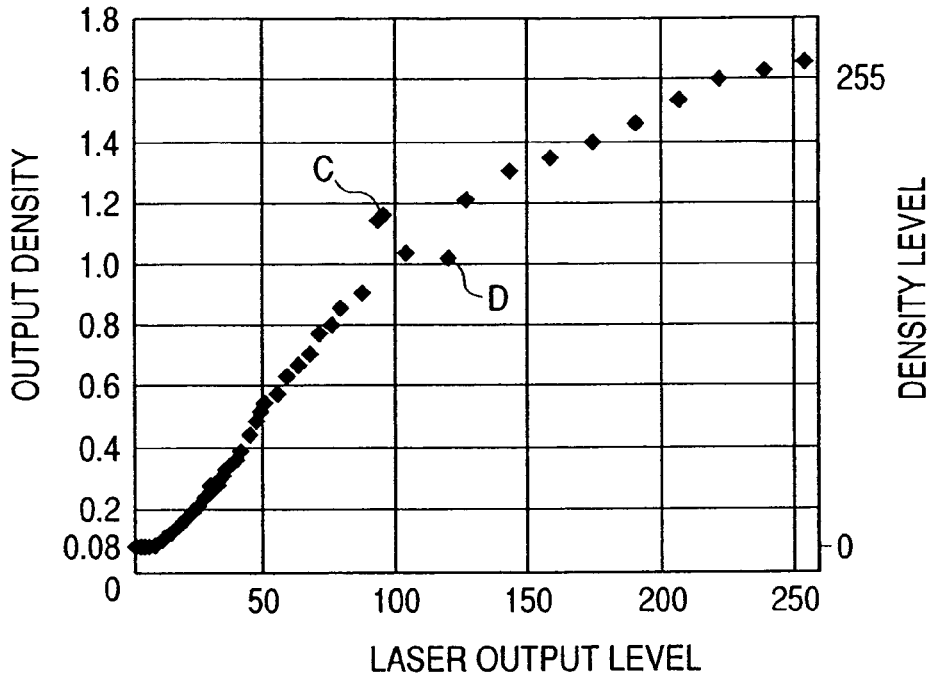
FIG. 19 is a view illustrating the relation between laser output level and density that has been read from the test print 2.

FIG. 19 is a view illustrating the relation between the laser output level (value of image signal) and the output density for which RGB signals obtained from each patch were converted into density values by the method for converting into optical density described in the foregoing. As shown on the longitudinal axis on the right side of FIG. 19, the maximum density target value 1.60 is normalized into 255 levels taking the background density (for example, 0.08) of the recording material 6 as level 0.

In a case where the density of a patch that has been read is exceptionally high, as shown by a point C in FIG. 19, or exceptionally low, as shown by a point D, it may be considered that dirt exists on the original platen glass 102 or that there is a defect in the test pattern. In that case, to maintain the continuity of a data row, a limiter is applied to the inclination of the data row to conduct correction. For example, when the inclination of the data row exceeds 3, the inclination is fixed at 3, and data for which the inclination is minus is made the same value as the patch of one density lower.

In the LUT 25, conversion characteristics that are the reverse to the characteristics shown in FIG. 19 may be set (S9 of FIG. 7). More specifically, the density level (longitudinal axis in FIG. 19) may be set as the input level (density signal in FIG. 6), and the laser output level (horizontal axis in FIG. 19) may be set as the output level (laser output signal in FIG. 6). A value for a level not corresponding to the patches is obtained using interpolating calculation. At this time, conditions are established whereby the output level is zero for an input level of zero.

Figure 10E:
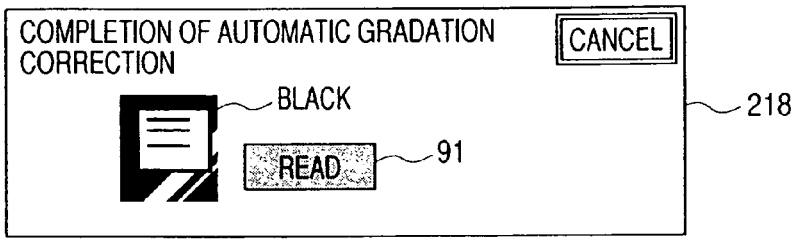

Thus, control of contrast potential and creation of a γLUT correction table by the first control system is completed, and the display illustrated in FIG. 10E is displayed by the display device 218.

As described above, potential control by the surface potential sensor 12 is a control that performs correction based on printing amount information with respect to an amount of printing (image formation) that has been conducted. As the printing amount information at that time, there can be employed count value information that has been obtained by counting either the period of time the surface of the photosensitive drum 4 has been exposed by the laser light source 110 as an exposure light source or the period of time the surface has been not exposed. Further, count value information obtained by counting the number of dots printed by an image signal may also be employed as the printing amount information.

[Supplementary Control of Gradation Characteristics]

Next, correction of gradation characteristics conducted following the foregoing control by the first control system will be described.

In addition to correction of maximum density with respect to fluctuations in environmental conditions by the foregoing contrast potential control, the image forming apparatus of this embodiment also conducts correction of gradation characteristics (referred to as "supplementary control of gradation characteristics").

Figure 20:
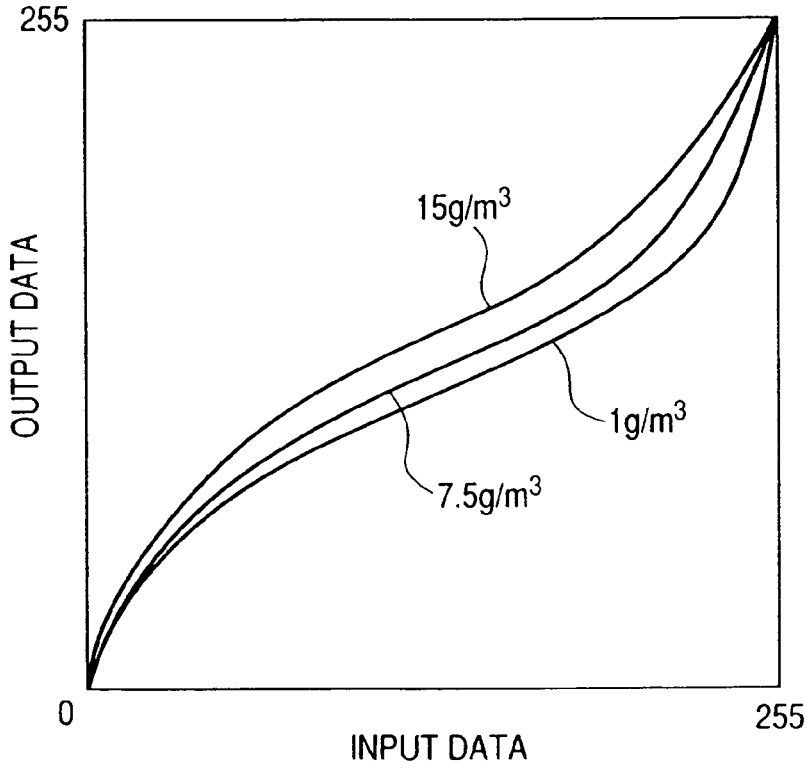
FIG. 20 is a view illustrating an LUT in accordance with moisture amount.

In consideration of cases where environmental changes occur while the first control system has been placed in an inoperative state, table data of the LUT 25 that is in accordance with the environment (for example, moisture amount of 1 g/m$^3$, 7.5 g/m$^3$ or 15 g/m$^3$), as shown in FIG. 20, is stored in the ROM 30.

Then, when control is carried out by the first control system, the resulting table data of the LUT 25 (referred to as "LUT1") and the moisture amount at that time are stored in a battery backed-up area of the ROM 30 or the like. The table data of the ROM 30 corresponding to the moisture amount stored in the ROM 30 is referred to as LUTA.

Thereafter, whenever the environmental conditions change, table data of the ROM 30 that corresponds to the moisture amount at that time (referred to as "LUTB") is acquired, and the LUT1 is corrected according to the following formula using the LUTA and the LUTB. More specifically, by adding to the LUT1 a difference between the LUTA and the LUTB that corresponds to a change in the moisture amount, the appropriate table data of the LUT 25, referred to as "LUTpresent," can be obtained by the following formula (5) without conducting control by the first control system.

$$LUT\text{present}=LUT1+(LUTB-LUTA) \quad (5)$$

The output and input characteristics of an image forming apparatus are linearly corrected by this supplementary control, and therefore variations in density gradation characteristics may be corrected for each individual image forming apparatus, enabling easy setting of the standard conditions.

By allowing the user of the image forming apparatus to carry out this kind of supplementary control, gradation control can be conducted as necessary when the user judges that the gradation characteristics of the image forming apparatus have deteriorated, enabling the gradation characteristics of a system including both a reader and printer to be easily corrected.

It is also possible to suitably carry out correction with respect to fluctuations in environmental conditions as described in the foregoing.

It hardly needs to be said that since the serviceman can switch the first control system between an operative and inoperative state, the first control system can be put in an inoperative state when conducting maintenance of the image forming apparatus to allow easy diagnosis of the state of the image forming apparatus in a short time. In this connection, when the first control system is made inoperative, the standard contrast potential and LUT 25 table data for that model are read from the ROM 30 and set in the CPU 28 and the LUT 25. Accordingly, at the time of maintenance, deviations in characteristics from the standard state become clear, enabling optimal maintenance to be conducted with good efficiency.

[Second Control System]

Next, a second control system that relates to stabilization of the independent image reproduction characteristics of the printer portion B will be described as image control carried out during normal image formation.

The second control system detects the density of patches formed on the photosensitive drum 4 to correct the LUT 25 and thus stabilize image reproduction characteristics.

Figure 21:
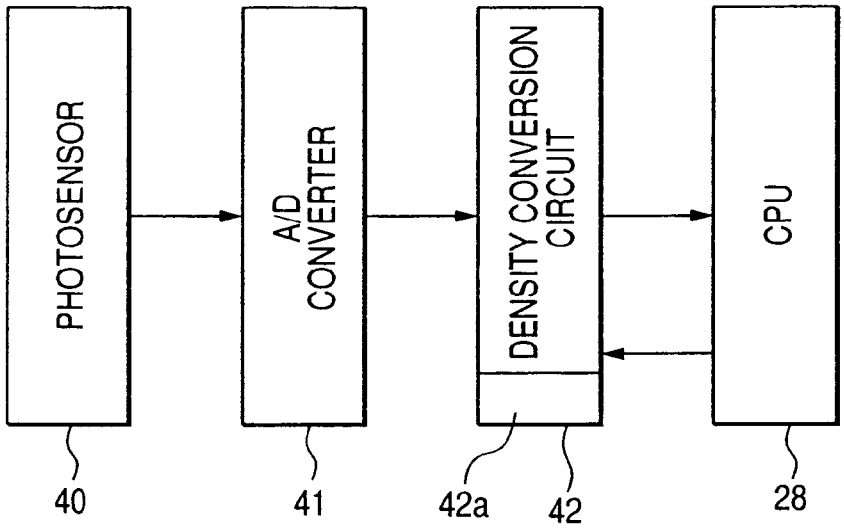
FIG. 21 is a block diagram showing a configuration example of a circuit for processing the output signals of a photosensor.

FIG. 21 is a block diagram showing an example of a circuit configuration that processes output signals of the afore-mentioned photosensor 40. Reflected light (far-red light) from the photosensitive drum 4 that is input into the photosensor 40 is converted into electrical signals. Electrical signals of 0 to 5 V are converted into 8-bit digital signals by an A/D converter 41, and then converted into density information by a density conversion circuit 42 based on a table 42*a*.

The toners used in this embodiment are toners for each of the colors yellow, magenta and cyan, in which coloring material of each color has been dispersed employing styrene copolymer resin as a binder. The photosensitive drum 4 is an OPC drum for which reflectivity of far-red light (960 nm) is approximately 40%, and an amorphous silicon-type photosensitive drum or the like may also be used as long as the reflectivity is of the same level. The photosensor 40 is configured so as to detect only specular reflected light from the photosensitive drum 4.

Figure 22:
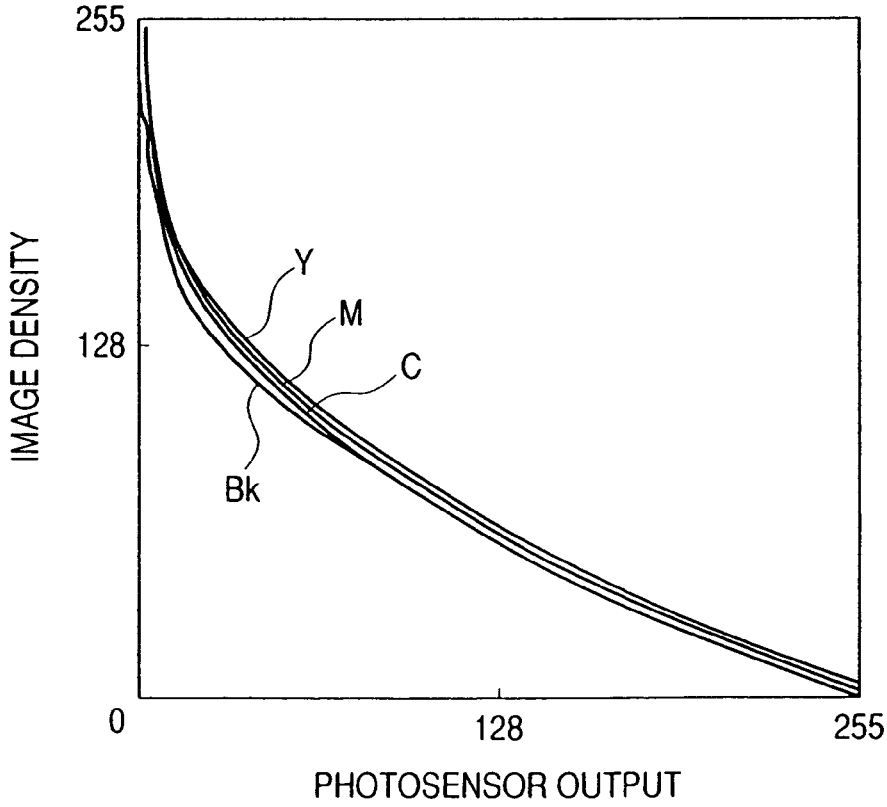
FIG. 22 is a view illustrating the relation between density of an output image and photosensor output when the density of patches has been gradually altered.

FIG. 22 is a view illustrating the relation between output of the photosensor 40 and output image density when the density of patches formed on the photosensitive drum 4 is gradually changed by area coverage modulation of each color. The output of the photosensor 40 in a state where toner is not attached to the photosensitive drum 4 is set at 5 V, that is, level 255. As shown in FIG. 22, output of the photosensor 40 decreases as the rate of area coverage by each toner increases and the image density increases.

On the basis of these characteristics, the table 42*a* (see FIG. 21) that converts from sensor output into density signals exclusively for each color can be prepared to enable the density to be read with high accuracy for each color.

Figure 23:
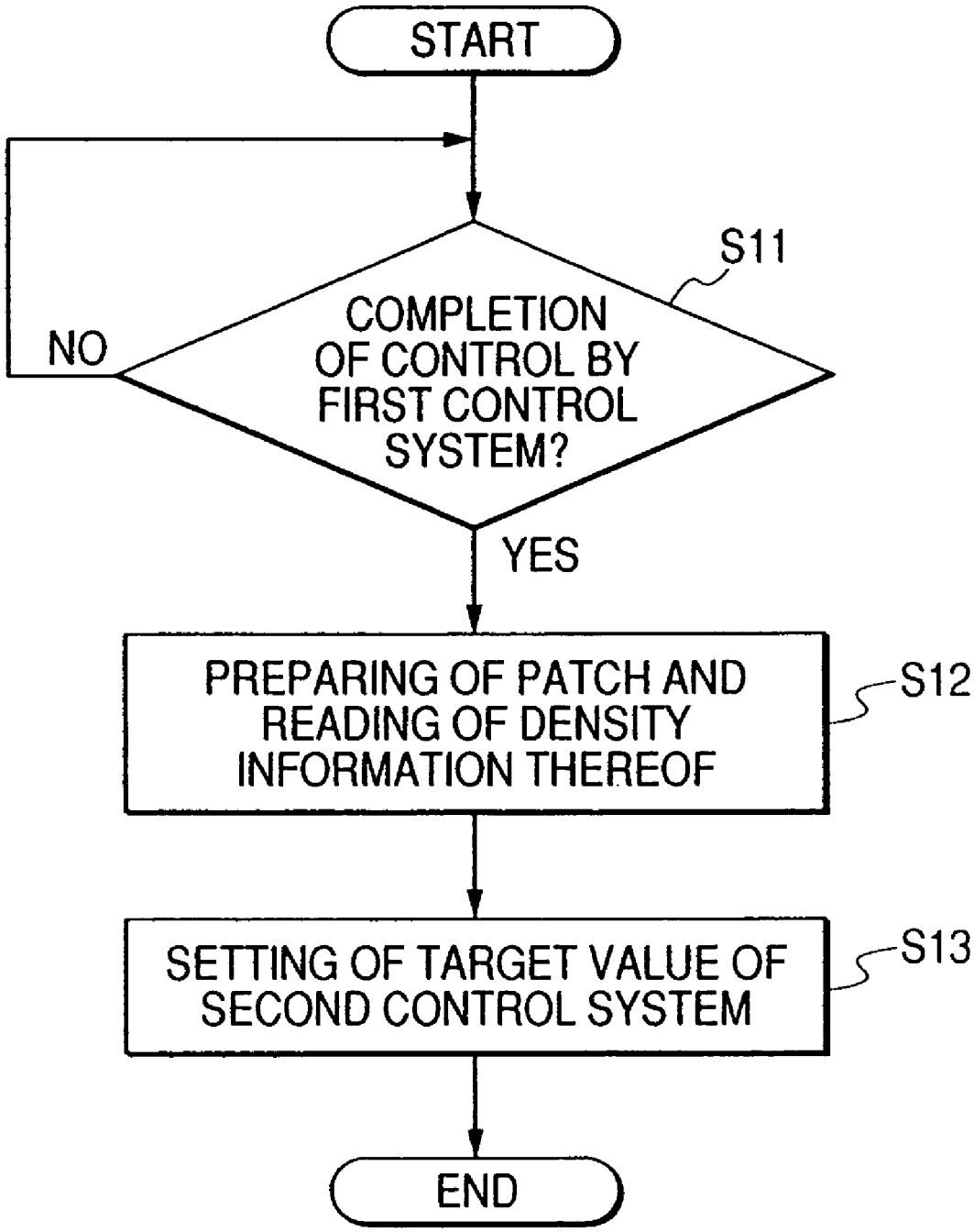
FIG. 23 is a flowchart showing one example of processing to set a target value.

The object of the second control system is to maintain the stability of the color reproduction achieved by the first control system, and thus the state immediately after completion of control by the first control system is set as the target value thereof. FIG. 23 is a flowchart showing one example of processing to set the target value.

When control by the first control system is completed (S11), patches for each of the colors Y, M, C and Bk are formed on the photosensitive drum 4 and reflected light thereof is read by the photosensor 40 and converted into density information (S12). The target value of the second control system is then set (S13).

As the laser output when forming the patches, a density signal of level 128 is used for each color. It should be noted that at such time the values obtained by the first control system are used as the table data of the LUT 25 and the contrast potential.

Figure 24:
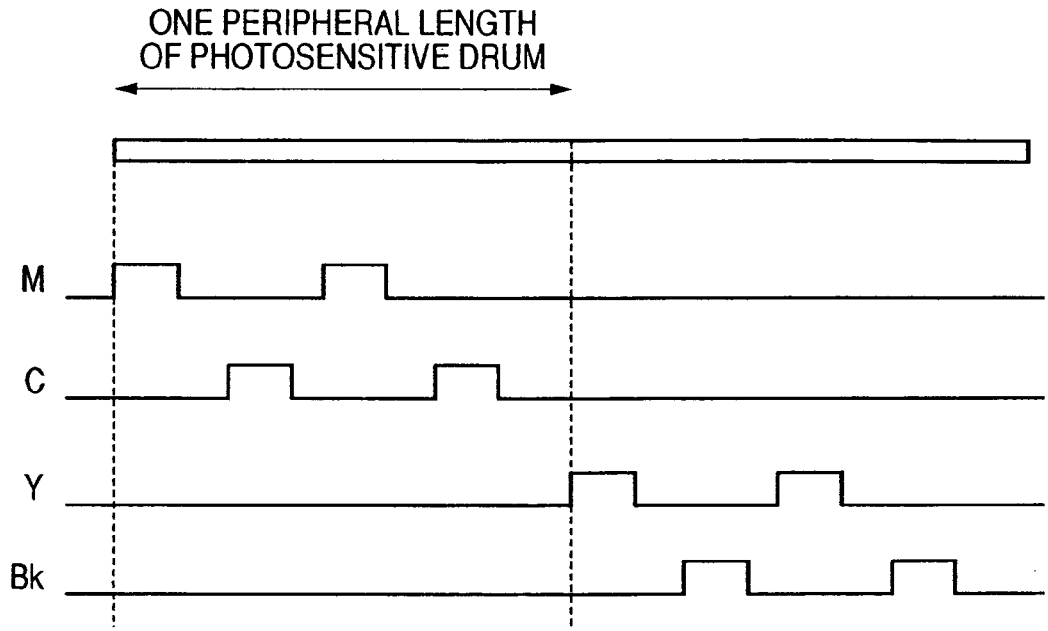
FIG. 24 is a view showing a sequence that forms patches on a photosensitive drum.

FIG. 24 is a view showing a sequence that forms a patch on the photosensitive drum 4.

In this embodiment, a photosensitive drum having a comparatively large bore (diameter) is used. In order to obtain density information accurately and with good efficiency in a short time, patches of the same color are formed at positions that are point symmetric with respect to the center of the photosensitive drum 4 in consideration of the eccentricity of the photosensitive drum 4, and a plurality of values obtained by measuring those patches are averaged to obtain the density information. Further, patches of two colors are formed per one peripheral length of the photosensitive drum 4 so that, as shown in FIG. 24, density information is obtained for four colors by rotating the photosensitive drum 4 twice. Then, density information corresponding to an image density of 128 is stored in the RAM 32 or the like as the target value of the second control system. This target value is renewed each time control is carried out by the first control system.

Figure 25:
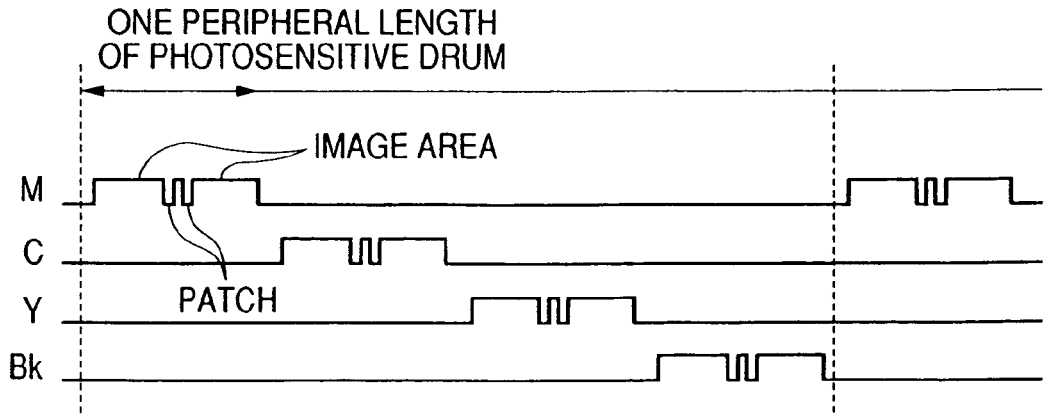
FIG. 25 is a view showing a sequence that forms patches in a non-image formation area on a photosensitive drum during normal image formation.

The second control system is a control that forms patches in a non-image formation area (=image formation area exterior: area outside the image formation area (image forming area) in which the image is formed. This term has the same meaning as "non-image forming area.") during normal image formation and detects the densities thereof to correct the table data of the LUT 25 obtained with the first control system whenever necessary. At the same time, the second control system is also a control that corrects as necessary the laser output itself by detecting potential with respect to a predetermined laser output value in a non-image formation area to maintain the latent image contrast obtained with the first control system. Since an area on the photosensitive drum 4 that corresponds to a gap part with respect to the recording material 6 that is wound around the transferring drum 5 is employed as a non-image formation area, patches are formed in that area and an exposure area for measuring potential is also provided there. FIG. 25 is a view showing a sequence that forms patches in a non-image formation area on the photosensitive drum 4 during normal image formation, showing an example in which A4-size full-color images are output in succession.

The potential control in the non-image formation area will now be described. In a case where sheets are passed through consecutively, a wide non-image formation area cannot be taken between sheets or the like for reasons associated with maintaining the speed of sheet passing. Therefore, a difficulty arises in that the increase of a grid bias in a primary charge or a developing bias accompanying the same requires a rise time. Accordingly, potential control is conducted by laser output.

Figure 26:
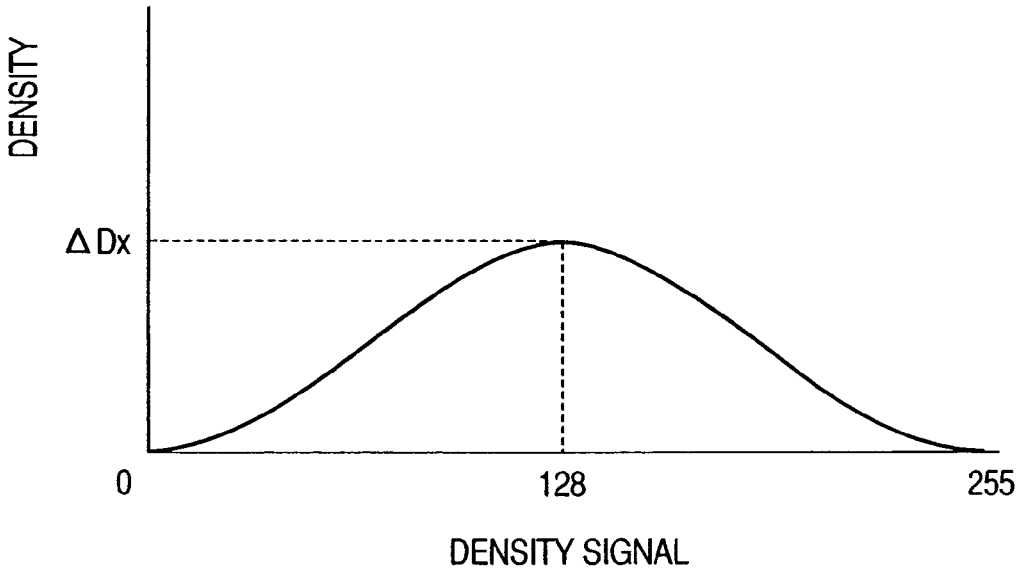
FIG. 26 is a view showing a γLUT correction table.
Figure 27:
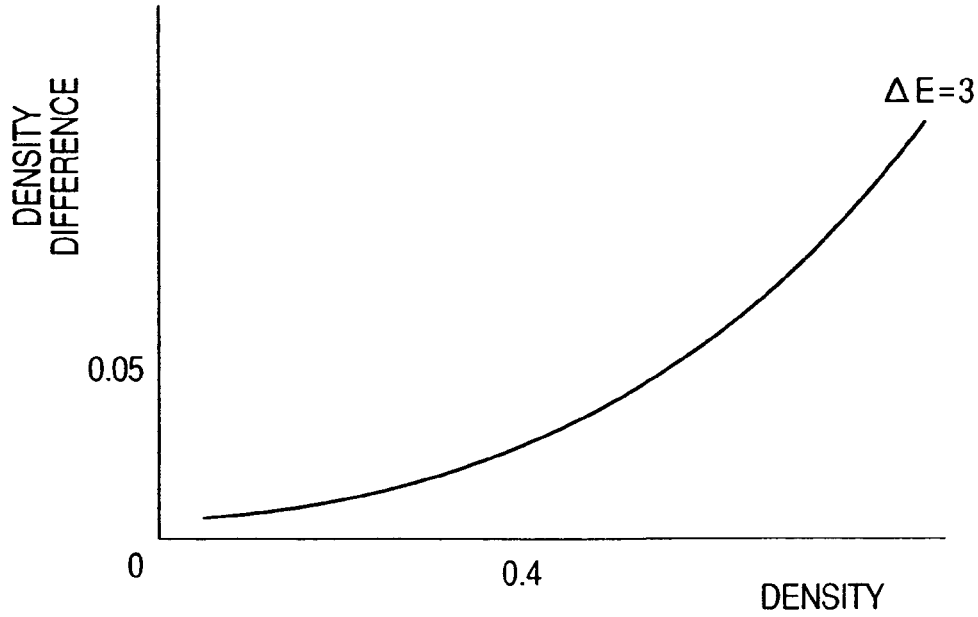
FIG. 27 is a view illustrating a relation between density and density difference.
Figure 30:
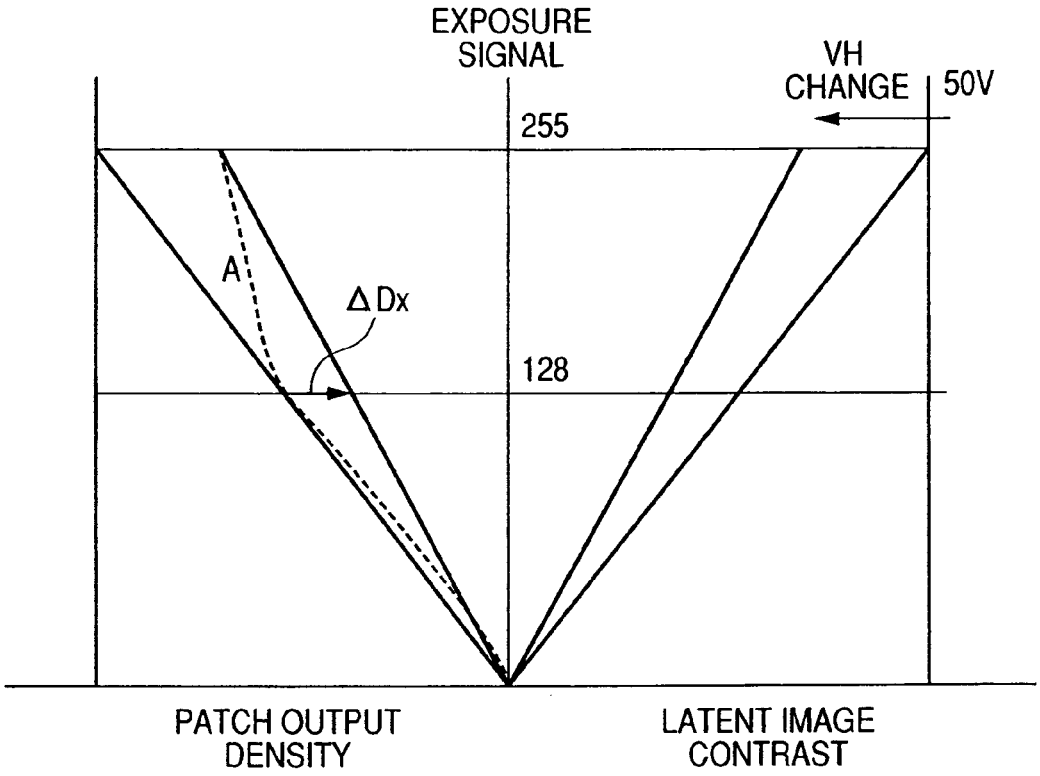
FIG. 30 is a schematic diagram illustrating a change in potential.

FIG. 27 shows the relation between density and density difference when a potential difference ΔE is 3 V. For example, residual charges of the maximum exposure portion potential of the photosensitive drum 4 accumulate and rise along with the number of passing sheets. Thus, since maximum latent image contrast is decreased as much as 50 V by about 10 passing sheets, correction is conducted to enhance laser output to correct the drop in latent image contrast. FIG. 30 is a schematic diagram illustrating the state of this change, and in a case where, for instance, this potential correction is not conducted the area ΔDx in the figure would be detected as a patch density, whereby an output result such as shown by a dotted line A in FIG. 30 may be generated by γ correction to be described later referring to FIG. 26.

Figure 31:
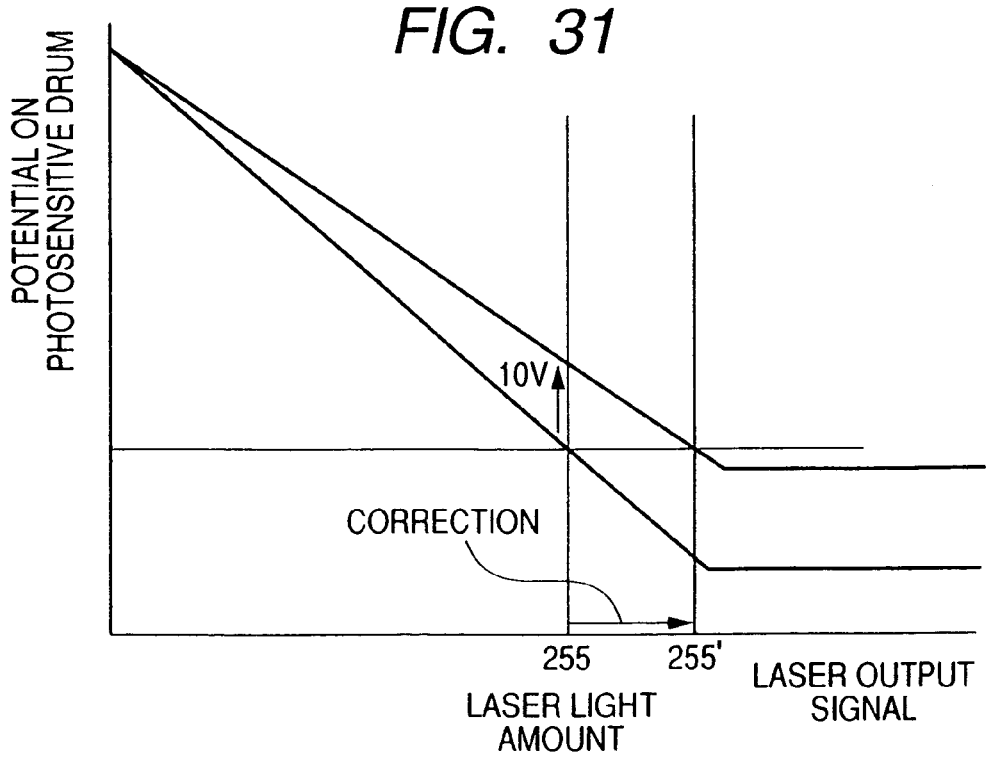
FIG. 31 is a view illustrating laser output correction.
Figure 32:
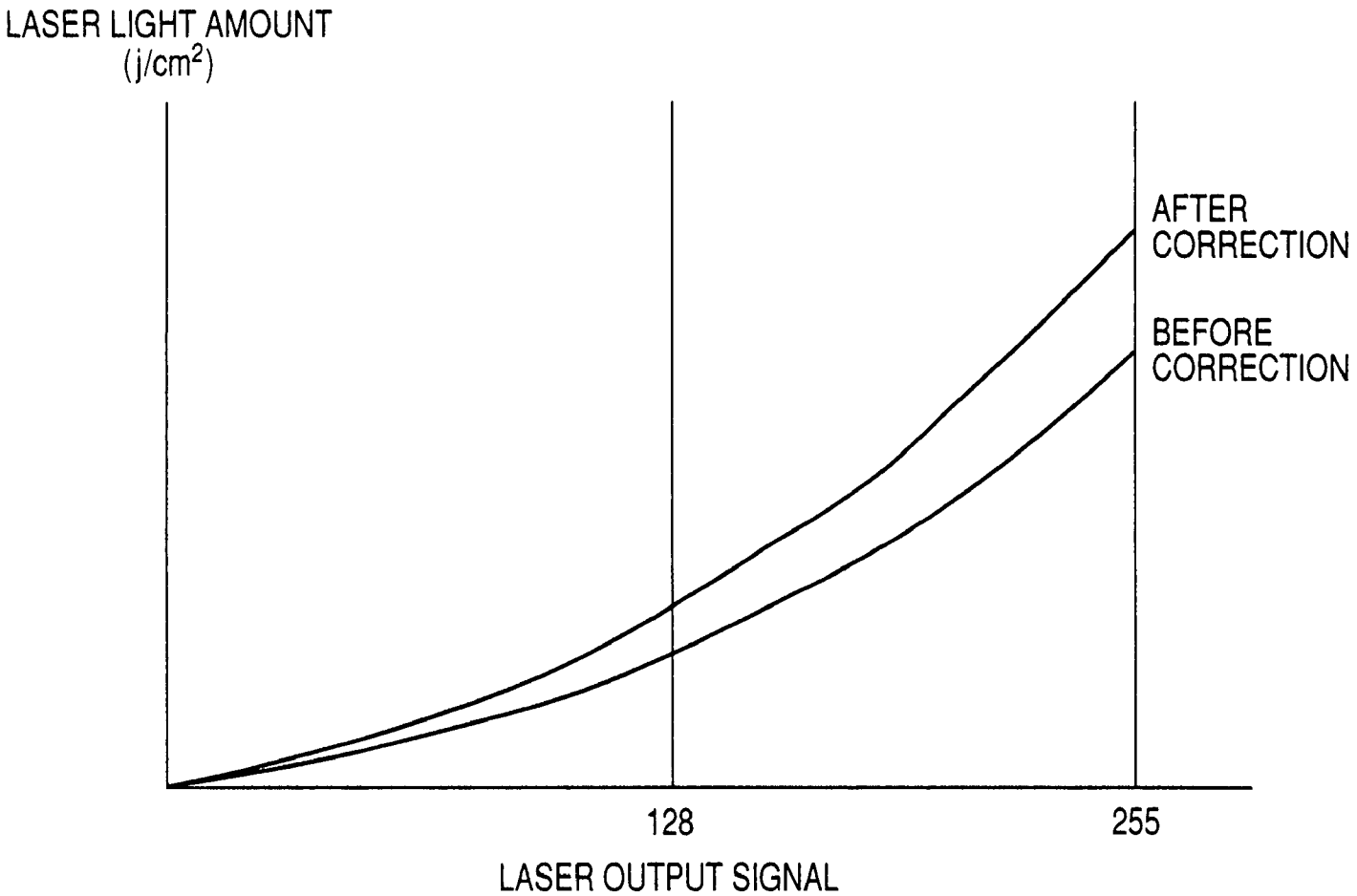
FIG. 32 is a view illustrating the relation between laser output signals and laser light amount before and after correction, respectively.

Thus, this potential control is control that is conducted as required in non-image formation areas, and when a change amount has exceeded 10 V the laser output is corrected to obtain the original potential. FIG. 31 schematically shows this situation. The maximum value for laser output is corrected to 255' in a case where sheet passing has been started with 255 in the figure as an initial setting and a rise of 10 V has been detected in an area in which exposure vs potential characteristics change linearly. FIG. 32 is a view that additionally describes the correction control, showing the relation between output light amount (image exposure light amount) before and after correction with respect to output signal values of 255 levels of gradation. Although a limit exists when the amount of fluctuation is large, and there is some impact on sheet passing speed in such case, it is possible to insert a timing pause equivalent to the amount for one sheet of recording material to conduct grid control.

Figure 33:
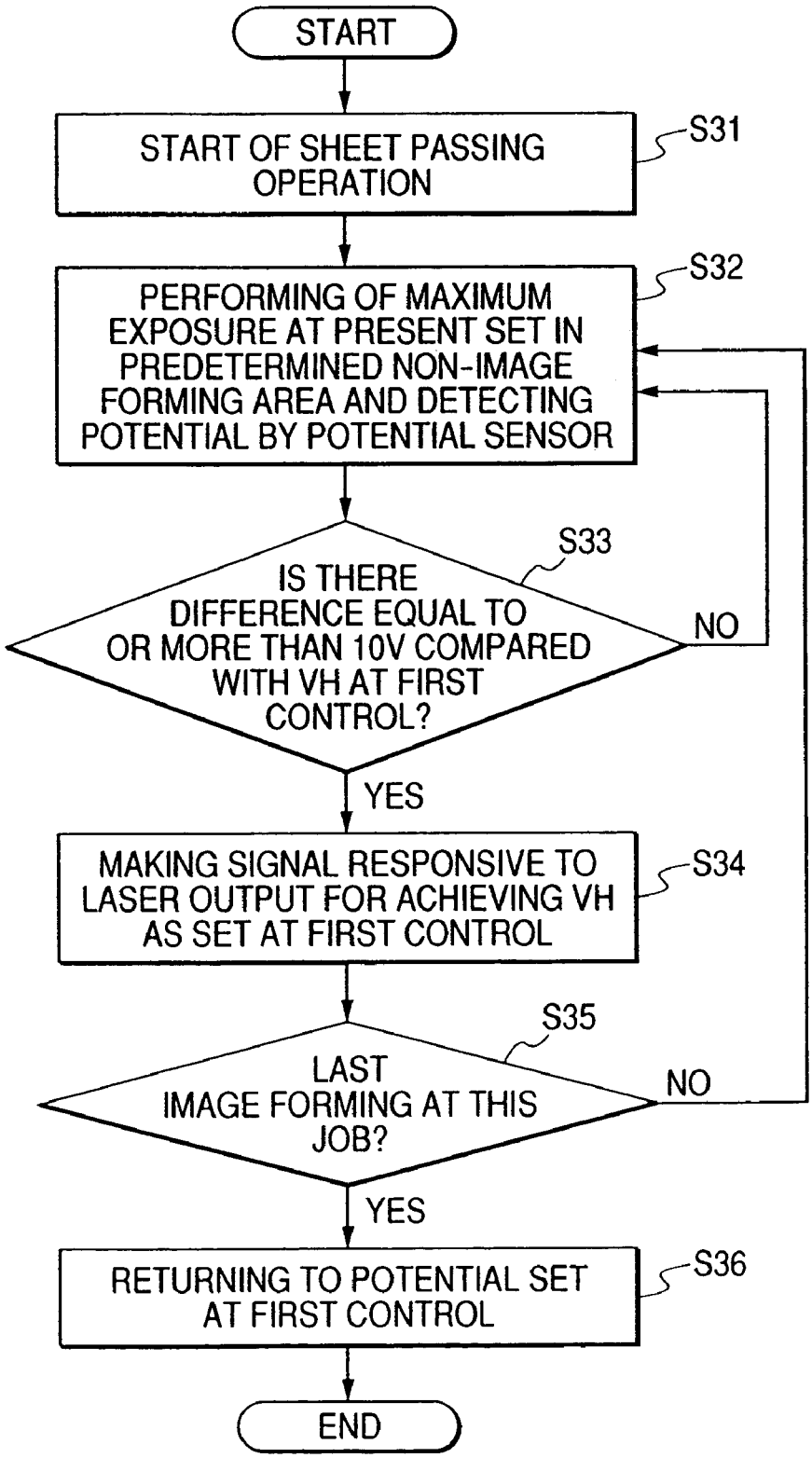
FIG. 33 is a flowchart illustrating the flow of potential control.

FIG. 33 is a flowchart showing the flow of potential control in this embodiment. When a sheet passing operation is started (S31), maximum exposure at the current settings is performed in a predetermined non-image formation area (non-image forming area) and potential is detected by the potential sensor 12 (see FIG. 1) (S32). It is then determined whether or not a difference of 10 V or more exists compared with the $V_H$ at the time of the first control (S33). If a difference of 10 V or more does not exist the control returns to step S32. When a difference of 10 V or more exists, the signal is made responsive to laser output for achieving $V_H$ as set at the time of the first control (S34). Then, if the operation is not the last image forming for the current job, the control returns to step S32. When the operation is the last image forming for the current job, the potential is returned to the potential set at the time of the first control (S36) and the control ends.

Thus, in this embodiment, at a stage when the last image forming is completed in a consecutive job that forms a plurality of images in succession while executing a countermeasure for short term variability of $V_H$, since $V_H$ is restored to its original potential several seconds after the end of exposure, that is, by the time of the next job, the settings obtained with the first control are restored.

Since it is important that the laser output when forming patches is equal to that at the time of setting the target value, a 128-level density signal is used for all the colors. The table data of the LUT 25 and contrast potential are made the same as when conducting normal image formation at that time. More specifically, the result obtained by correcting the table data of the LUT 25 that has been obtained with the first control system, by means of the control of the second control system up to the previous time and the afore-mentioned potential contrast control up to the previous time is used as a gamma correction table. At this time, for the table data of the LUT 25, it has been verified that even when laser output power is corrected by means of potential contrast control the potential characteristics with respect to a 255-signal laser output become almost equal by means of the correction, and thus there is no particular necessity for a change to be made in response to a laser output signal and the 128 level can be normally used as before.

For the 128-level density signal, while densities of patches are corrected to become 128 by the LUT 25 of a density scale in which a density of 1.6 has been normalized into 255 levels, the image characteristics of the printer portion B are unstable and there is a constant possibility that a change will occur. Therefore, it is not the case that the density of the measurement result will be 128. Based on the deviation ΔD between this density signal and the measurement result, in the second control system the table data of the LUT 25 created with the first control system is corrected.

FIG. 26 is a view showing a common γLUT correction table for density signals when a deviation in a patch density with respect to a 128-level density signal is ΔDx. This γLUT correction table is previously stored in the ROM 30 or the like, and at the time of control by the second control system the γLUT correction table is normalized so that ΔDx becomes ΔD, and table data that counteracts the characteristics of the normalized γLUT correction is added to the table data of the LUT 25 to correct the LUT 25.

The timing at which the LUT 25 is rewritten (corrected) differs for each color. When rewriting preparations have been completed, rewriting is conducted based on a TOP signal in a period in which laser beam scanning (sensitizing) of the color in question is not being conducted.

ΔD is the deviation between the target value obtained from patches formed using the LUT 25 at the previous time and the density obtained from patches formed using the LUT 25 this time. However, since formation of patches is conducted each time using the LUT 25 that has been corrected by the second control system of the previous time, a deviation ΔDn between the density of the patches that were read and the target value is different to ΔD. Therefore, the integrated value of ΔDn is stored as ΔD.

Figure 29:
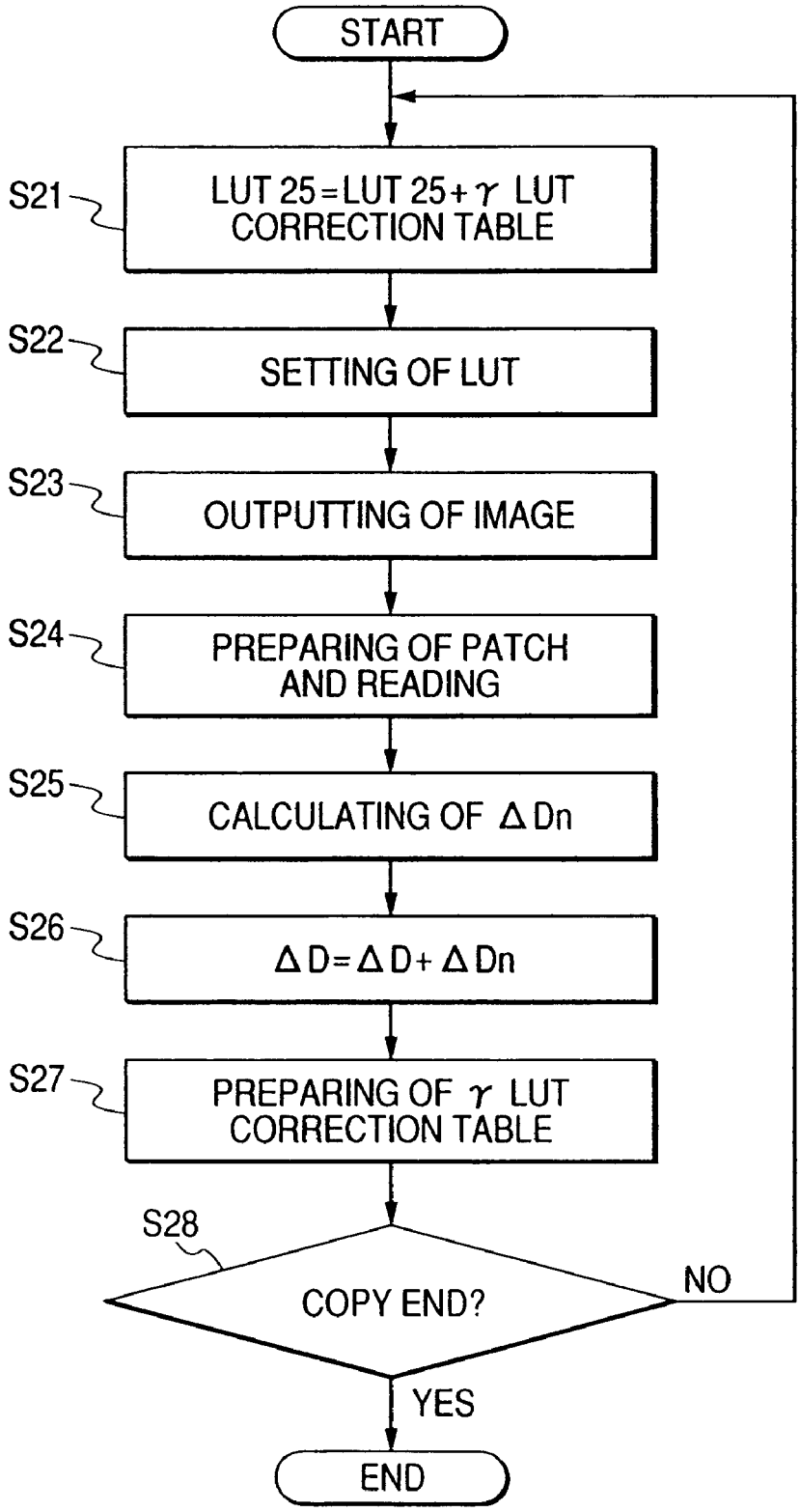
FIG. 29 is a flowchart illustrating processing to prepare a γLUT correction table.

FIG. 29 is a flowchart showing processing that creates a γLUT correction table, which is started concurrently with the start of normal image formation.

First, table data of the LUT 25 is corrected with the γLUT correction table obtained by the second control system at the previous time (S21), the LUT 25 is then set using the table data obtained as the result of correction (S22), and an image is output using the LUT 25 (S23). At that time, a patch is formed on the photosensitive drum 4 and the density of the patch is read (S24). Then, ΔDn is calculated (S25), the integrated value ΔD=ΔD+ΔDn is obtained (S26), and a γLUT correction table is created (S27) Thereafter, judgment is made as to whether or not to continue the print job (S28), and if the job is to be continued the processing returns to step S21. If the job is completed, the processing ends.

The timing at which the LUT 25 is rewritten (corrected) differs for each color. When rewriting preparations have been completed, rewriting is conducted based on a TOP signal in a period when laser beam scanning (sensitizing) of the color in question is not being conducted.

ΔD is the deviation between the target value obtained from patches formed using the LUT 25 at the previous time and the density obtained from patches formed using the LUT 25 this time. However, since formation of patches is conducted each time using the LUT 25 that has been corrected by the second control system of the previous time, the deviation ΔDn between the density of the patches that were read and the target value is different to ΔD. Therefore, the integrated value of ΔDn is stored as ΔD.

As described in the foregoing, according to this embodiment, by effectively combining potential control by the surface potential sensor 12 in a non-image formation area with γ correction control by conventional patch density detection with respect to short-term fluctuations in the potential of the photosensitive drum 4, it is possible to achieve image forming (image formation) that has a more stable color tint over the long-term.

Second Embodiment

Figure 34:
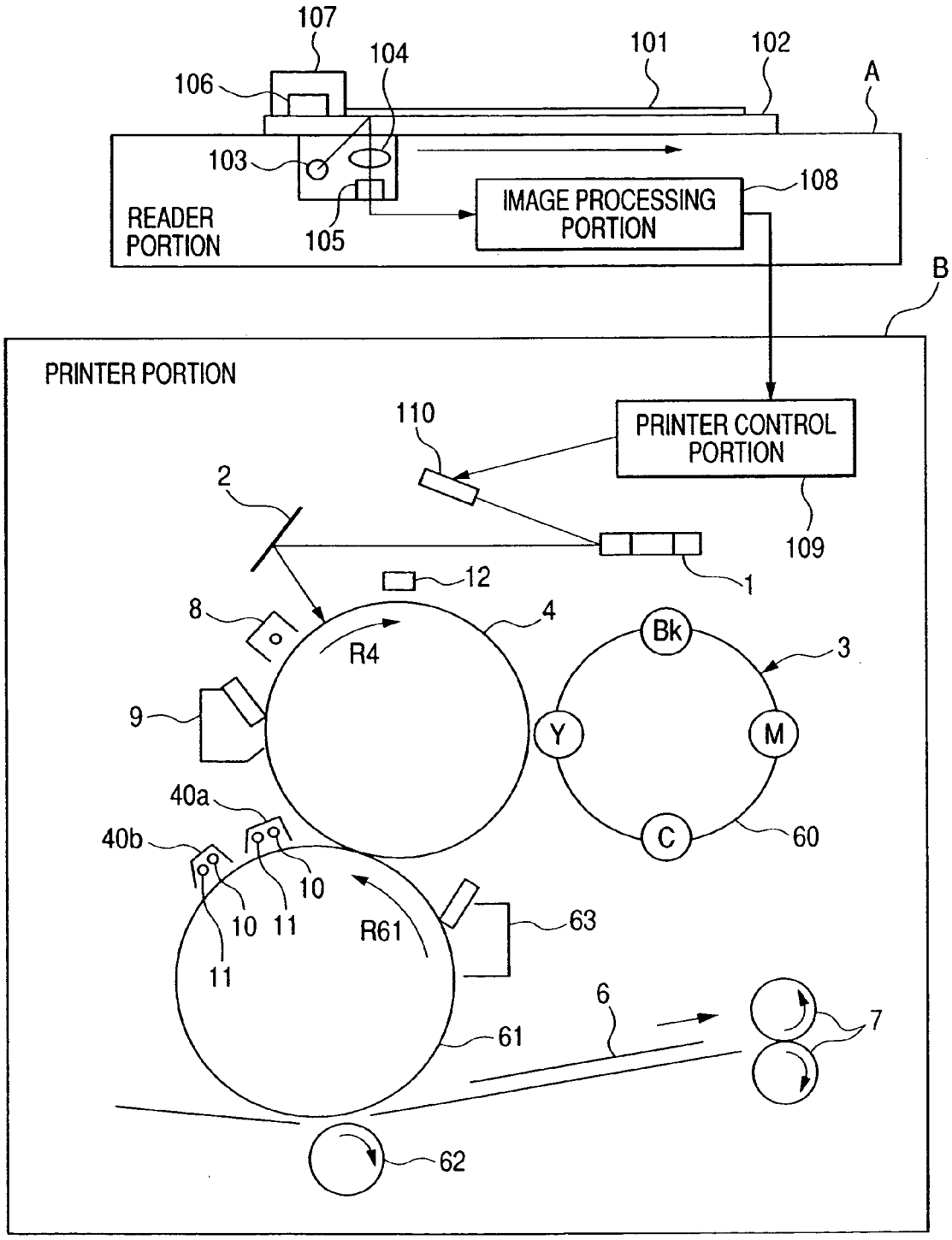
FIG. 34 is a view that schematically shows an outline configuration of an image forming apparatus according to Embodiment 2.

FIG. 34 is an illustration of an image forming apparatus according to Embodiment 2. For this embodiment, the same symbols are used for components that are roughly the same as in Embodiment 1, and a detailed description is omitted for those components.

In this embodiment, developing devices for four colors, more specifically, developing devices 3 of yellow (Y), cyan (C), magenta (M) and black (Bl), are mounted on a rotatable rotary 60 such that, by means of rotation of the rotary 60, the developing device of a color to be supplied for development of an electrostatic latent image on the photosensitive drum 4 can move to a development position facing the photosensitive drum 4.

The image forming apparatus shown in FIG. 34 comprises an intermediate transferring drum (intermediate transferring member) 61 to which a toner image formed on the photosensitive drum 4 is transferred (primary transfer), a secondary transferring roller 62 that transfers (secondary transfer) a toner image on the intermediate transferring drum 61 to a transferring material 6, and a drum cleaner 63 that removes unwanted toner (secondary transfer residual toner) that remained on the intermediate transferring drum 61. The drum cleaner 63 is separated from the intermediate transferring drum 61 while a four-color toner image is being formed sequentially on the photosensitive drum 4, and after the toner image on the intermediate transferring drum 61 has undergone secondary transfer to the transferring material 6, the drum cleaner 63 is contacted against the surface of the intermediate transferring drum 61 to clean the intermediate transferring drum 61. The intermediate transferring drum 61 is of a size that enables image formation of two A4-size images with a space of approximately 60 mm therebetween.

In contrast to Embodiment 1 in which the photosensor 40 is disposed over the photosensitive drum 4, in this embodiment two photosensors 40*a* and 40*b* are disposed side by side in a longitudinal direction over the intermediate transferring drum 61. In this case, because cleaning cannot be conducted until a four-color toner image is transferred, only patches of one color can be formed in the same position on the intermediate transferring drum 61 until toner images corresponding to the amount of two sheets of A4-size transferring material are transferred to the transferring material 6. Therefore, γ correction is possible for two colors, that is, a maximum of an amount of two colors per two sheets of A4-size transferring material, corresponding to the positions of the photosensors 40*a* and 40*b* that are disposed longitudinally.

Figure 35:
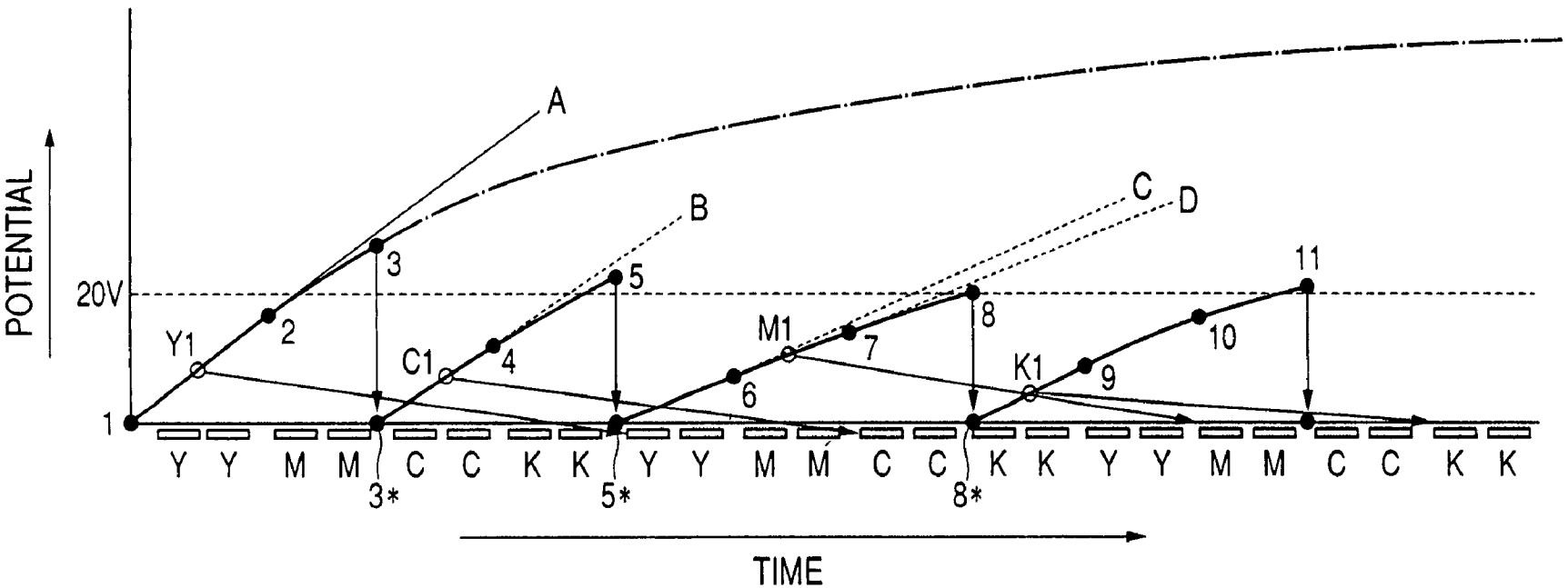
FIG. 35 is a view showing one example of the timing of potential control and patch control in Embodiment 2.

FIG. 35 is a view showing control timing for potential control and a second control system in this embodiment. In the figure, the horizontal axis indicates sheet passing time, the longitudinal axis indicates potential, an alternate long and short dashed line indicates transitions in the amount of variation of $V_H$ potential from the start of sheet passing when potential control has been not conducted, a continuous line indicates transitions in the amount of variation of $V_H$ potential when potential control has been conducted, and the rectangular boxes shown in the order of YYMMCCKK along the horizontal axis indicate the timing for forming an A4-size image (image formation timing) of each color. In this connection, black is denoted by the reference character "K" in the figure instead of "Bk." Further, a "•" symbol on a line indicates timing of potential detection on the photosensitive drum 4, and a "○" symbol indicates timing of image density detection by means of patches on the intermediate transferring drum 61. It is necessary that the timing for image density detection is the timing at which the rotary 60 is stopped in a state where, for each color, the developing device 3 is facing the photosensitive drum 4, that is, between the first and second A4 images, and as described in the foregoing, only the amount for two colors can be detected until the amount of two sheets from Y to K is transferred to the transferring material 6. Further, for potential detection, although exposure for $V_H$ can also be carried out by shifting a position longitudinally while simultaneously forming the afore-mentioned electrostatic latent image for patches, the detection is conducted by measuring the center of the photosensitive drum each time at a timing at which the rotary 60 rotates which is different to timing for exposure for patches to obtain the average potential.

For the potential control, first a straight line A is assumed that joins two points consisting of a detection value at detection timing 1 and a detection value at detection timing 2 to predict the potential at timing 3, and when the predicted value exceeds 20 V, laser output correction, that is, an increase in laser output, is carried out in the same manner as in Embodiment 1 at the timing 3. In this instance, while a case may be considered in which the result detected at the timing 2 can be reflected in the operations conducted at the immediately following magenta (M) image formation, it is assumed that the processing would not be completed in sufficient time since a certain of amount of time is required for various kinds of computational processing, comparative processing, exposure output responses and the like. Subsequently, timing 5 is predicted from timing 3* and 4. Further, for example, when the predicted value of timing 7 that is predicted by a straight line C of timing 5 and 6 does not exceed 20 V, a value in timing 8 is predicted by a straight line D of timing 6 and 7 to conduct correction.

At this time, LUT 25 γ correction by means of an image density detection using patches is conducted at a timing indicated by the symbol o in the figure, and the correction result is reflected in the subsequent image formation operation for the same color. Accordingly, at a level at which a latent image contrast change does not exceed 20 V, gamma correction can be conducted as a case for which potential is stable, enabling a stable image density to be maintained.

Although $V_H$ fluctuations due to exposure of the photosensitive drum 4 are also dependent on the exposure amount, since the potential detection area is a non-image formation area and this area is only irradiated by the previous exposure, in a case where, for example, potential is predicted to conduct control, correction can also be performed using an integrated value for video count or the like as the image amount. For example, when forming an image that mostly comprises only a white background, the detected potential of the non-image formation area may be used as it is, while in the case of an image that is mostly black, by applying a correction coefficient based on data measured previously by experimentation as an image for which potential rises more or the like, thus enabling more accurate control.

Further, while a method that corrects a laser light amount when a change in potential exceeds 20 V is employed as the method for controlling potential of this embodiment, it is preferable that the timing for detection of patch density is carried out as much as possible in an interval in which the potential conditions are maintained in the state in which the target value has been initially determined. Therefore, by ensuring that detection is carried out regardless of whatever kind of change in potential existed at the timing of the immediately preceding patch density, control of a higher degree of accuracy is also enabled.

Other Embodiments

The present invention may be applied to a system composed of a plurality of devices (for example, a host computer, interface device, reader and printer etc.) or may be applied to an apparatus comprising one device (for example, an apparatus such as a copier or facsimile machine).

The objects of this invention can also be achieved by supplying to a system or image forming apparatus a storage medium (or recording medium) on which is recorded program code of software that implements the functions of the afore-mentioned embodiments, so that a computer (or CPU or MPU) of the system or image forming apparatus reads and implements the program code stored on the storage medium.

In this case, the program code itself that is read from the storage medium realizes the functions of the afore-mentioned embodiments, and the storage medium that stores the program code comprises this invention. The invention also includes a case in which, by implementing the program code that is read out from a computer, not only are functions of the afore-mentioned embodiments implemented, but also an operating system (OS) or the like operating on the computer conducts a part or all of the actual processing based on the instructions of the program code to implement functions of the afore-mentioned embodiments by that processing.

The invention also includes a case in which, after a program code that has been read out from a storage medium is written in a memory provided in an expansion unit connected to a computer or an expansion card inserted in a computer, a CPU or the like provided in the expansion unit or expansion card conducts a part or all of the actual processing based on instructions of the program code to implement functions of the afore-mentioned embodiment by that processing.

When applying this invention to the afore-mentioned storage medium, a program code corresponding to flowcharts described in the foregoing is stored in the storage medium.

Although a photosensitive drum has been mentioned in each of the above-described embodiments as an example of an image bearing member that bears a toner image or an electrostatic latent image, the present invention can also be applied to a photosensitive belt that is a belt-shaped image bearing member having a photosensitive layer on the surface thereof. This invention can also be applied to an image forming apparatus having an intermediate transferring member (for example, an intermediate transferring belt or intermediate transferring drum) to which a toner image is temporarily transferred from the photosensitive drum in order to transfer the toner image to the recording material 6 or a recording medium such as a film. In these image forming apparatuses, density information as input information of the second control system may be acquired from patches formed on the photosensitive belt or intermediate transferring member.

In the foregoing description, examples were described of cases in which this invention is applied to an electrophotographic four-color full color image forming apparatus, however this invention is not limited thereto. For example, the invention can be applied in a similar manner as described above to a monochrome (black and white) image forming apparatus that uses an electrophotographic method, as well as monochrome and four-color full color image forming apparatuses that use methods other than an electrophotographic method, and a similar effect can be achieved when applied thereto.

This application claims priority from Japanese Patent Application No. 2003-428474 filed on Dec. 24, 2003, which is hereby incorporated by reference herein.

What is claimed is:

1. An image forming apparatus comprising:

a photosensitive member;

electrostatic image forming means forming an electrostatic image by exposing a surface of the photosensitive member;

developing means developing the electrostatic image on the photosensitive member with a toner;

potential detecting means detecting a potential of a predetermined electrostatic image that has been formed on the photosensitive member; and correcting means for predicting a surface potential of the photosensitive member on the basis of a detection result previously detected by the potential detecting means and a detection results currently detected during a period in which a plurality of images are formed in succession to correct an exposure output of the electrostatic image forming means in accordance with the predicted surface potential.

2. The image forming apparatus according to claim 1, wherein the correcting means performs correction processing during a period in which a plurality of images are formed in succession.

3. The image forming apparatus according to claim 1, wherein the potential detecting means detects a potential of an area to be used as an image portion.

4. The image forming apparatus according to claim 1, which has density detecting means that detects a density of a toner image obtained by developing an electrostatic image after correction processing by the correcting means, and which corrects image forming conditions in accordance with the detection result of the density detecting means.

* * * * *

UNITED STATES PATENT AND TRADEMARK OFFICE

CERTIFICATE OF CORRECTION

PATENT NO. : 7,113,712 B2
APPLICATION NO. : 11/014783
DATED : September 26, 2006
INVENTOR(S) : Fumiteru Gomi It is certified that error appears in the above-identified patent and that said Letters Patent is hereby corrected as shown below:

COLUMN 4:
Line 67, “sub scanning” should read --sub-scanning--.

COLUMN 14:
Line 48, “area.”)” should read --area”)--.

COLUMN 16:
Line 59, “(S27)” should read --(S27).--.

COLUMN 17:
Line 28, “(Bl),” should read --(Bk),--

COLUMN 20:
Line 42, “results” should read --result--.

Signed and Sealed this

Third Day of April, 2007

JON W. DUDAS
*Director of the United States Patent and Trademark Office*